US010714843B2

(12) United States Patent
Sato et al.

(10) Patent No.: US 10,714,843 B2
(45) Date of Patent: Jul. 14, 2020

(54) ELECTRIC WIRE WITH TERMINAL AND METHOD FOR MANUFACTURING ELECTRIC WIRE WITH TERMINAL

(71) Applicant: Yazaki Corporation, Tokyo (JP)

(72) Inventors: Tomoya Sato, Makinohara (JP); Naoki Ito, Makinohara (JP); Yasunori Nabeta, Makinohara (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/391,547

(22) Filed: Apr. 23, 2019

(65) Prior Publication Data

US 2019/0356062 A1 Nov. 21, 2019

(30) Foreign Application Priority Data

May 21, 2018 (JP) ..... 2018-097005

(51) Int. Cl.
*H01R 4/20* (2006.01)

(52) U.S. Cl.
CPC ..... *H01R 4/20* (2013.01)

(58) Field of Classification Search
CPC ..... H01R 4/18–206
USPC ..... 439/877–882
See application file for complete search history.

(56) References Cited

U.S. PATENT DOCUMENTS

2004/0088857 A1 5/2004 Fujimoto et al.
2011/0094797 A1 4/2011 Otsuka et al.
2013/0025935 A1 1/2013 Takayama et al.
2013/0040509 A1* 2/2013 Mitose ..... H01R 4/185 439/877
2013/0040511 A1* 2/2013 Takashima ..... H01R 4/024 439/882
2013/0095708 A1* 4/2013 Mitose ..... H01R 4/184 439/878
2015/0126079 A1* 5/2015 Kawamura ..... H01R 4/206 439/877

FOREIGN PATENT DOCUMENTS

JP S53-12097 A 2/1978
JP 2011-192465 A 9/2011
JP 2014011133 A 1/2014
JP 5428789 B2 2/2014

* cited by examiner

*Primary Examiner* — Gary F Paumen
(74) *Attorney, Agent, or Firm* — Sughrue Mion, PLLC

(57) ABSTRACT

A method for manufacturing an electric wire with a terminal includes forming a bonded part in which outer peripheral surfaces of strands are bonded to one another on an end portion of a core wire having the strands, in an electric wire in which the end portion is exposed from a covering; installing the bonded part onto a crimp terminal including a bottom part and a pair of caulking pieces extending from the bottom part and facing each other; crimping the caulking pieces to the bonded part, by sandwiching the crimp terminal and the electric wire between a first mold supporting the crimp terminal and a second mold moving relative to the first mold; and cutting a tip end portion projecting to outside from the caulking pieces in the bonded part by a cutting unit, while the caulking pieces are pressing the bonded part toward the bottom part.

2 Claims, 34 Drawing Sheets

ELECTRIC WIRE WITH TERMINAL AND METHOD FOR MANUFACTURING ELECTRIC WIRE WITH TERMINAL

CROSS-REFERENCE TO RELATED APPLICATION(S)

The present application claims priority to and incorporates by reference the entire contents of Japanese Patent Application No. 2018-097005 filed in Japan on May 21, 2018.

BACKGROUND OF THE INVENTION

1. Field of the Invention

The present invention relates to an electric wire with a terminal and a method for manufacturing an electric wire with a terminal.

2. Description of the Related Art

Conventionally, a technique for reducing the electrical resistance between an electric wire and a terminal fitting has been known. Japanese Patent No. 5428789 discloses a method for manufacturing an electric wire with a terminal fitting that executes a process of sandwiching an exposed core wire with a pair of jigs, and applying ultrasonic vibration to the core wire from the jigs; a process of cutting the core wire in an area applied with the ultrasonic vibration in the core wire; and a process of crimping a crimping part by winding the crimping part around an area including the area applied with the ultrasonic vibration in the core wire from outside. In the manufacturing method disclosed in Japanese Patent No. 5428789, a plurality of strands are welded to one another by the ultrasonic vibration.

In this process, when the area applied with the ultrasonic vibration is being cut, cracking may occur in the area or peeling off of strands may occur in the area. Thus, there is a demand for improving the electrical performance of an electric wire with a terminal while suppressing the cracking and peeling off of the strands.

SUMMARY OF THE INVENTION

An object of the present invention is to provide an electric wire with a terminal and a method for manufacturing an electric wire with a terminal capable of improving electrical performance.

According to one aspect of the present invention, a method for manufacturing an electric wire with a terminal includes a bonding process that forms a bonded part in which outer peripheral surfaces of a plurality of strands are bonded to one another on an end portion of a core wire having the strands, in an electric wire in which the end portion is exposed from a covering; an installation process that installs the bonded part onto a crimp terminal including a bottom part and a pair of caulking pieces extending from the bottom part and facing each other; a crimping process that crimps the caulking pieces to the bonded part, by sandwiching the crimp terminal and the electric wire between a first mold that supports the crimp terminal and a second mold that moves relative to the first mold; and a cutting process that cuts a tip end portion projecting to outside from the caulking pieces in the bonded part by a cutting unit, while the caulking pieces are pressing the bonded part toward the bottom part.

According to another aspect of the present invention, an electric wire with a terminal includes an electric wire including a core wire having a plurality of strands and a covering that covers the core wire while an end portion of the core wire is being exposed; and a crimp terminal including a core wire crimping part crimped to the core wire, wherein in the core wire, a portion at a tip end side including a portion crimped to the core wire crimping part is a bonded part in which outer peripheral surfaces of the strands are bonded to one another, a tip end surface of the bonded part projects to outside from the core wire crimping part and is a cut surface, and in the cut surface, end surfaces of the strands are brought into contact with one another, and face a same direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an electric wire with a terminal and a method for manufacturing an electric wire with a terminal according to an embodiment of the present invention will be described in detail with reference to the accompanying drawings. It is to be understood that this invention is not limited to the embodiment. Moreover, components described in the following embodiment include components that can be easily assumed by those skilled in the art and components that are substantially the same.

Embodiment

Figure 1:
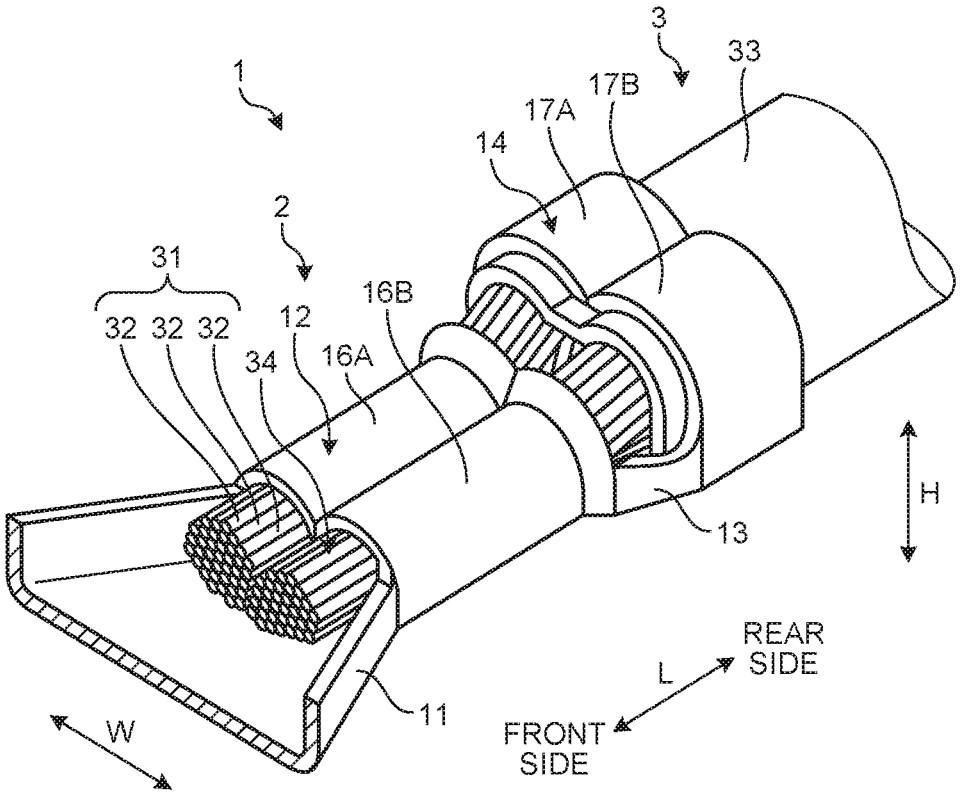
FIG. 1 is a perspective view of an electric wire with a terminal according to an embodiment.
Figure 2:
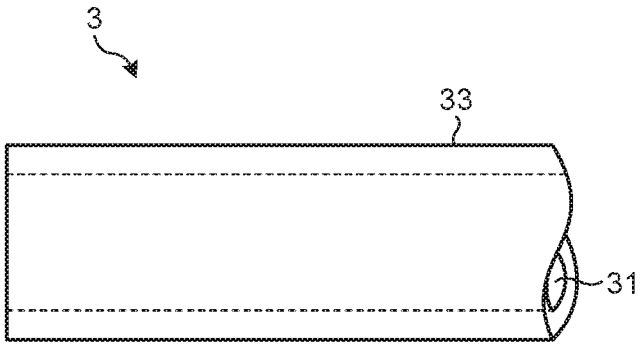
FIG. 2 is a plan view of an electric wire according to the embodiment.
Figure 3:
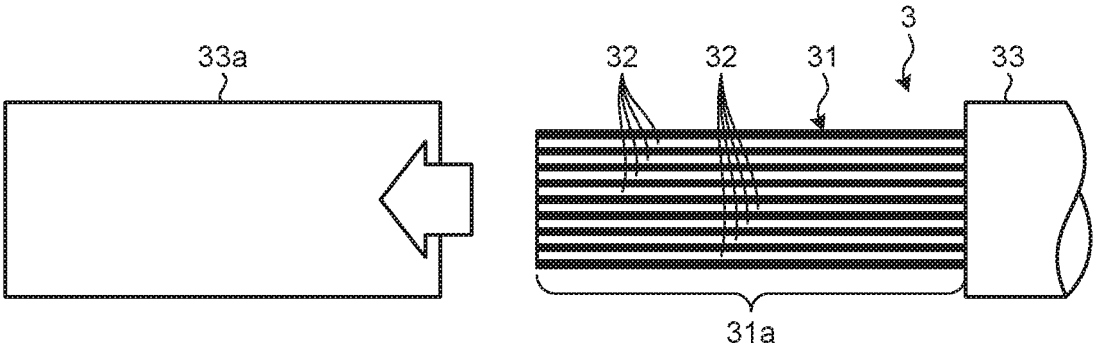
FIG. 3 is a diagram for explaining a removing process of the embodiment.
Figure 4:
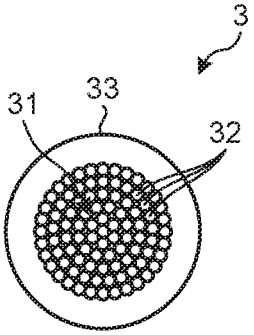
FIG. 4 is a front view of the electric wire according to the embodiment.
Figure 5:
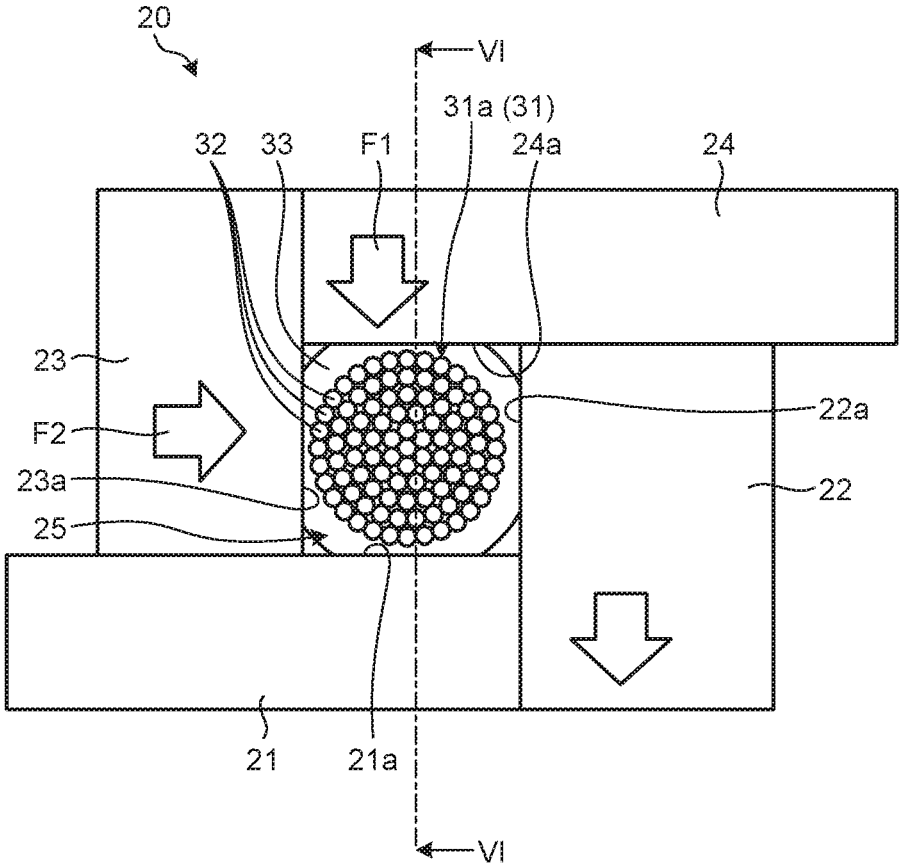
FIG. 5 is a front view illustrating an ultrasonic bonder according to the embodiment.
Figure 6:
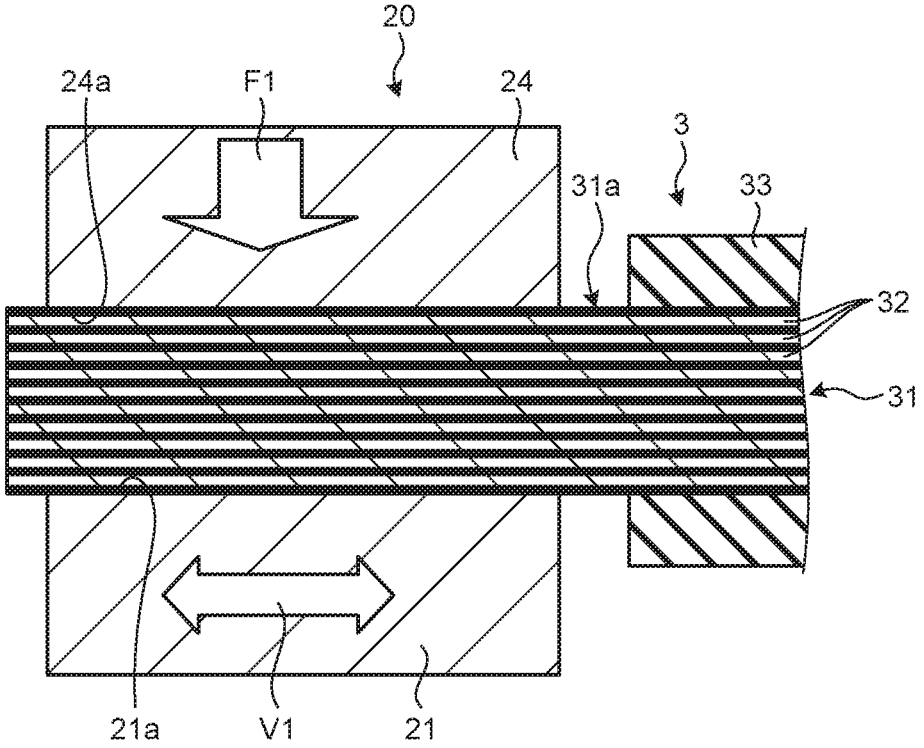
FIG. 6 is a sectional view illustrating the ultrasonic bonder according to the embodiment.
Figure 7:
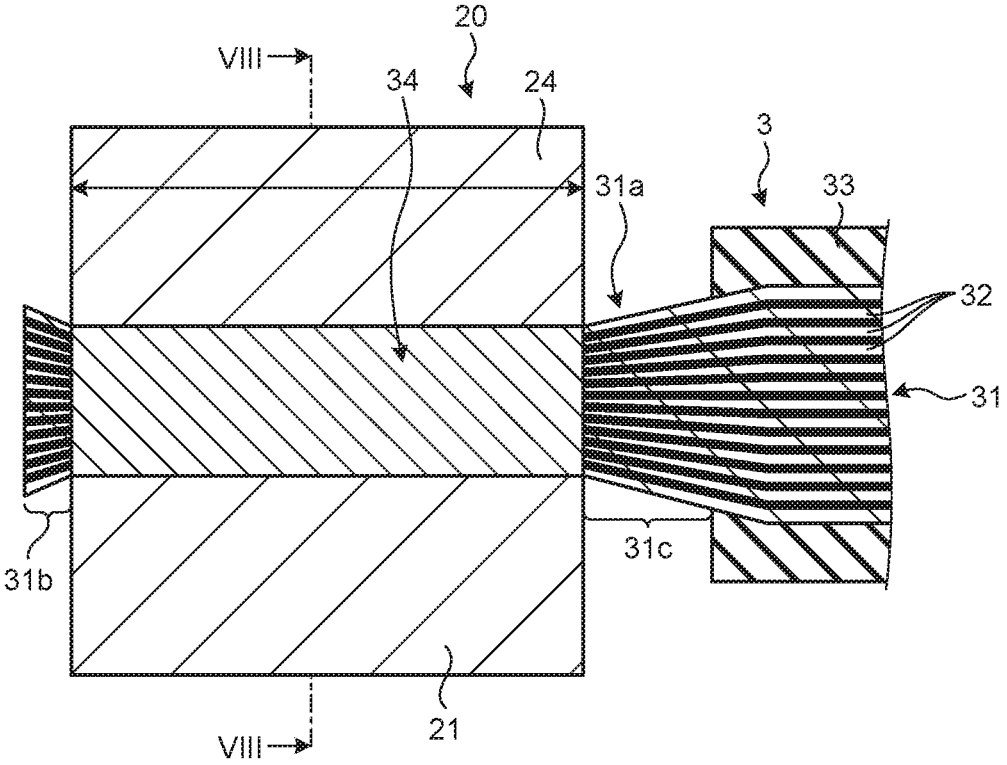
FIG. 7 is a sectional view for explaining a bonding process of the embodiment.
Figure 8:
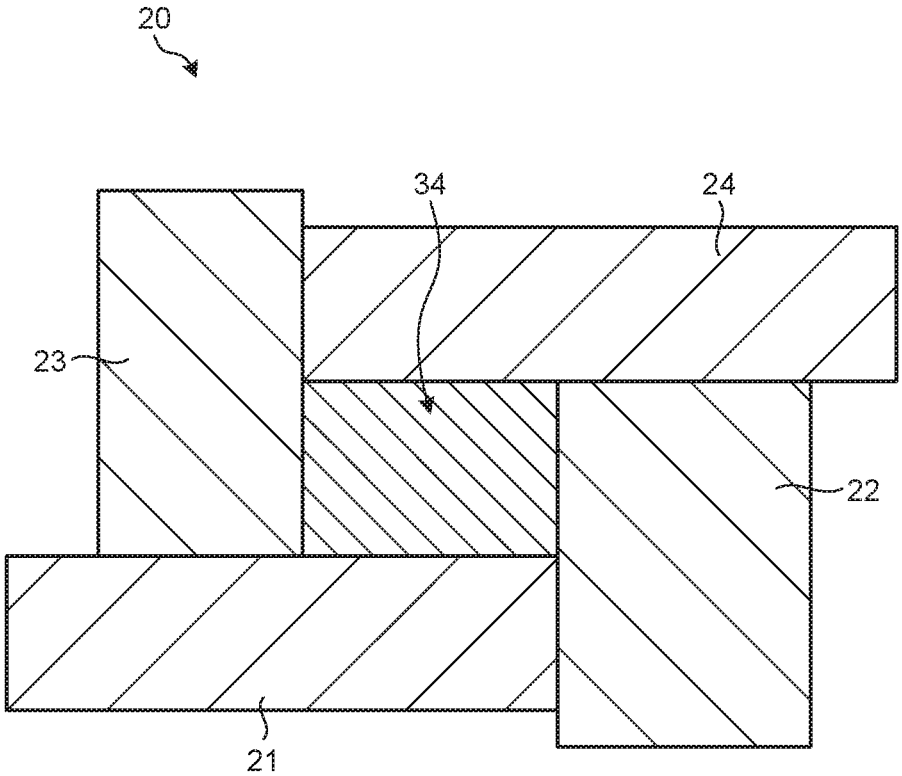
FIG. 8 is another sectional view for explaining the bonding process of the embodiment.
Figure 9:
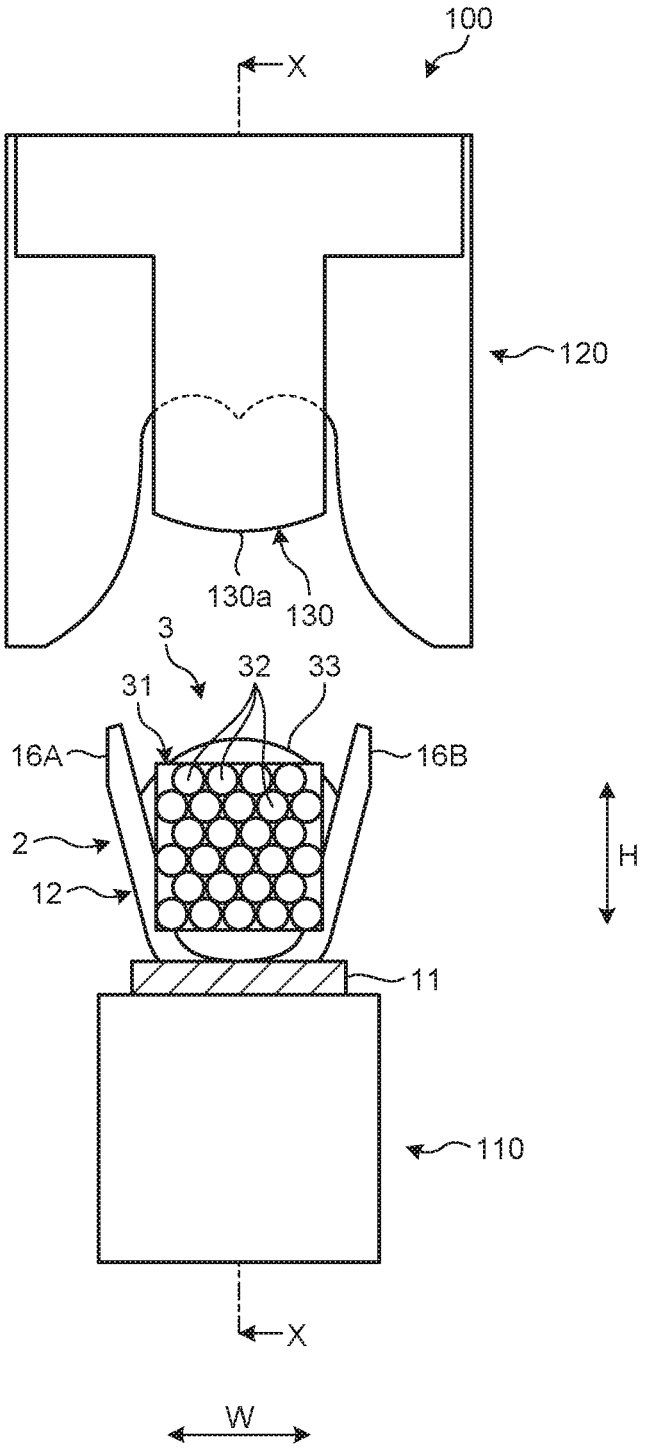
FIG. 9 is a front view illustrating a terminal crimping device according to the embodiment.
Figure 10:
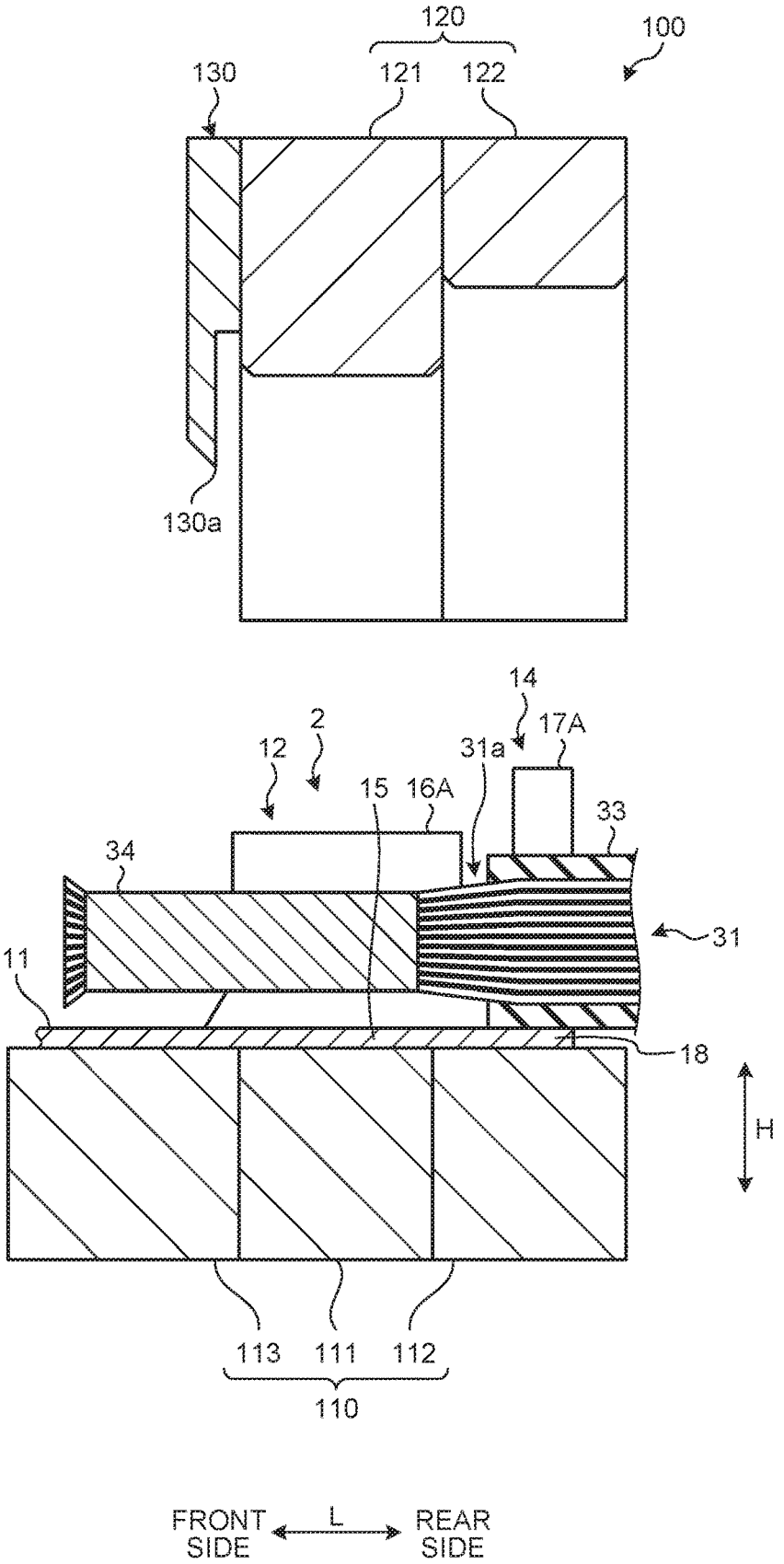
FIG. 10 is a sectional view illustrating the terminal crimping device according to the embodiment.

An embodiment will now be described with reference to FIG. 1 to FIG. 26. The present embodiment relates to an electric wire with a terminal and a method for manufacturing an electric wire with a terminal. FIG. 1 is a perspective view of the electric wire with a terminal according to the embodiment. FIG. 2 is a plan view of an electric wire according to the embodiment. FIG. 3 is a diagram for explaining a removing process of the embodiment. FIG. 4 is a front view of the electric wire according to the embodiment. FIG. 5 is a front view illustrating an ultrasonic bonder according to the embodiment. FIG. 6 is a sectional view illustrating the ultrasonic bonder according to the embodiment. FIG. 7 is a sectional view for explaining a bonding process of the embodiment. FIG. 8 is another sectional view for explaining the bonding process of the embodiment. FIG. 9 is a front view illustrating a terminal crimping device according to the embodiment. FIG. 10 is a sectional view illustrating the terminal crimping device according to the embodiment.

Figure 11:
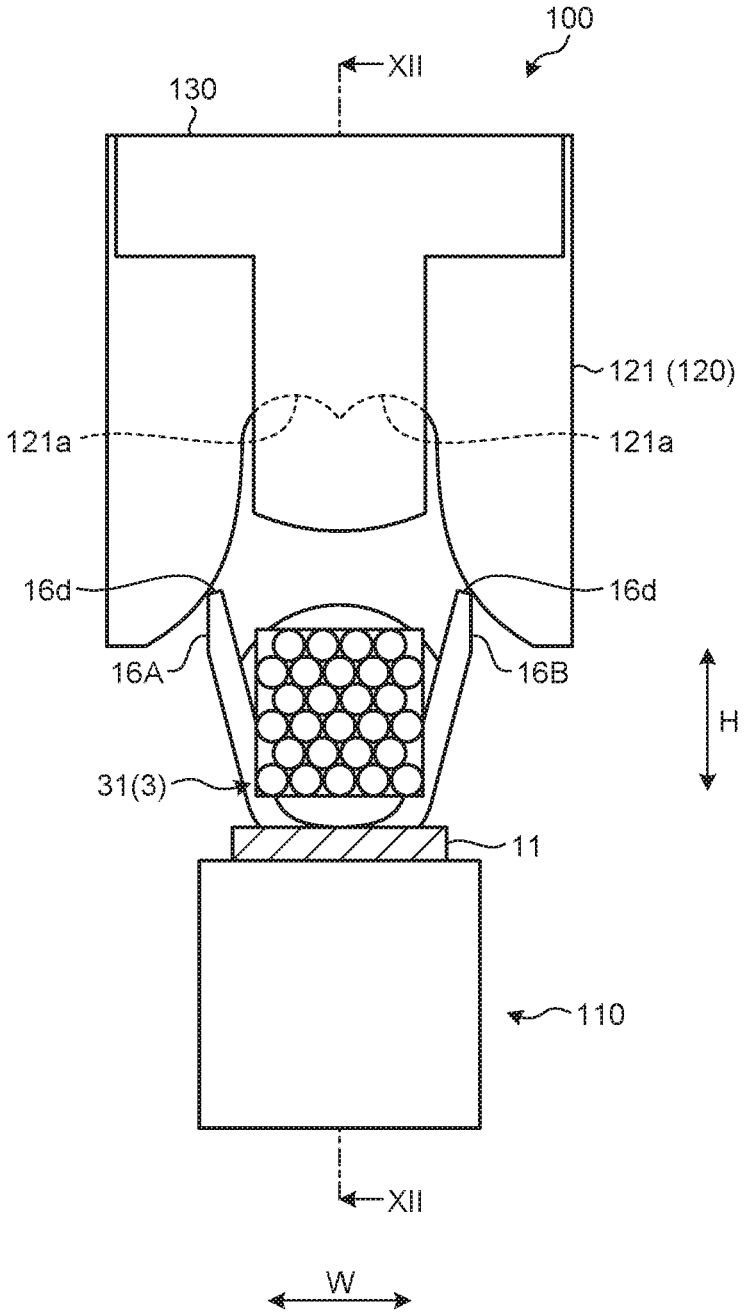
FIG. 11 is a sectional view for explaining a crimping process of the embodiment.
Figure 12:
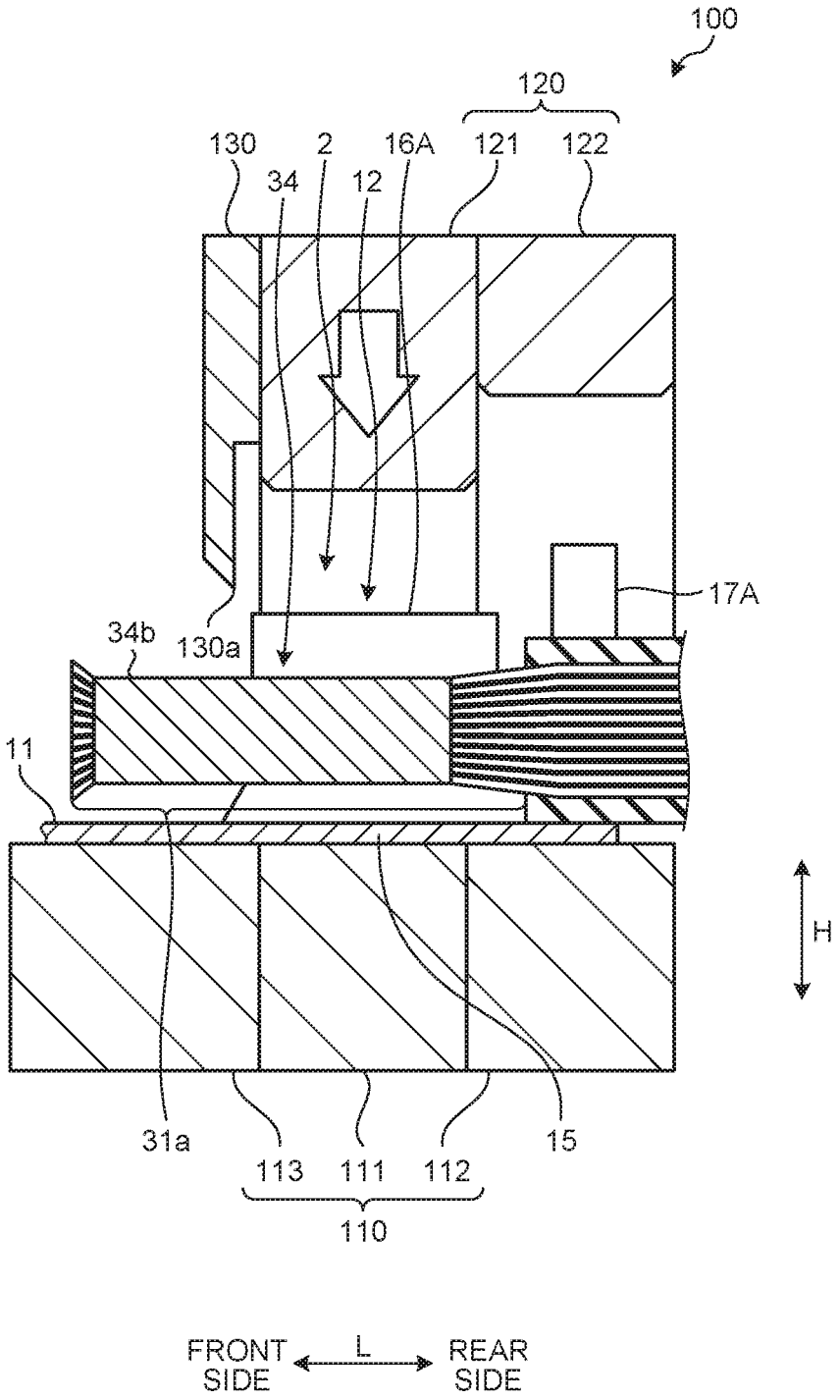
FIG. 12 is another sectional view for explaining the crimping process of the embodiment.
Figure 13:
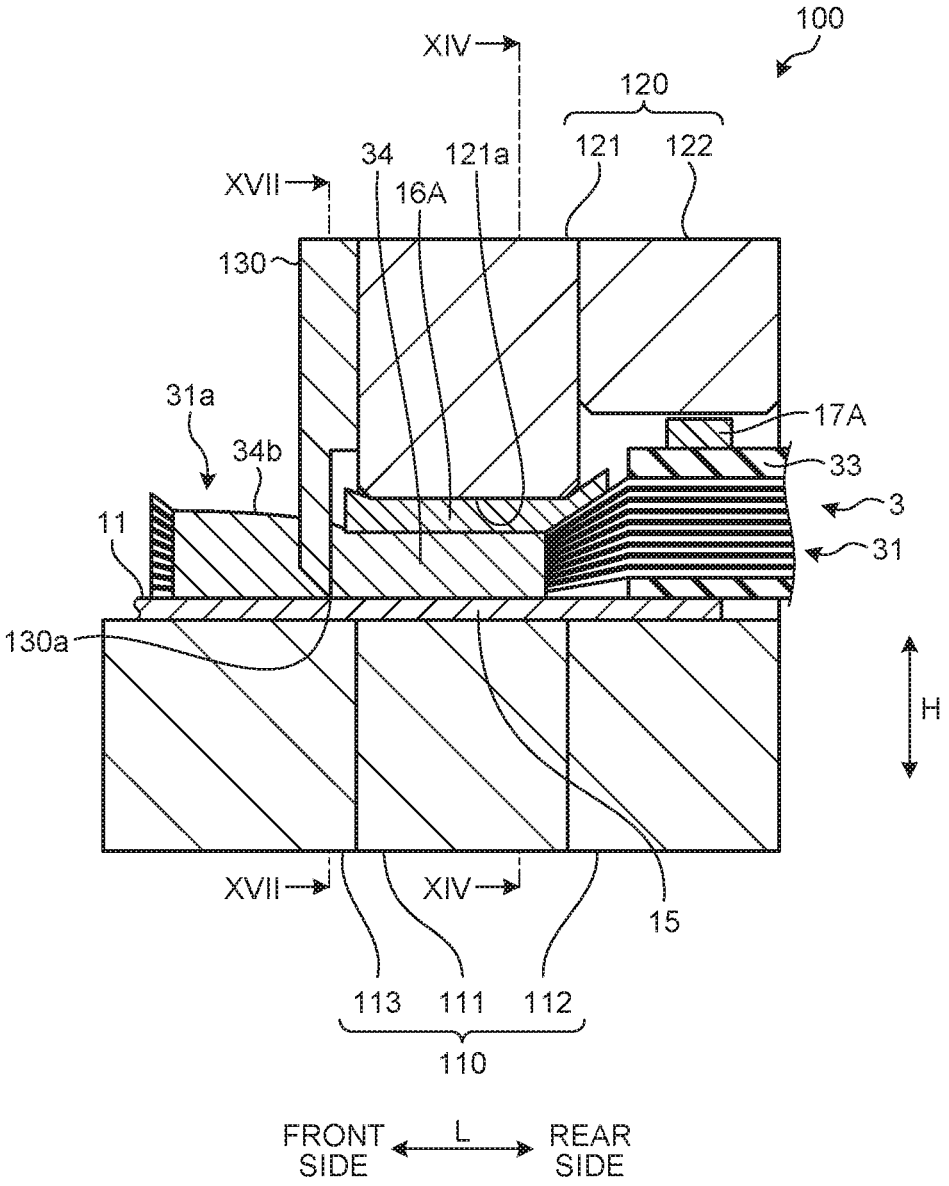
FIG. 13 is a sectional view illustrating a state when a second mold is at a bottom dead center.
Figure 14:
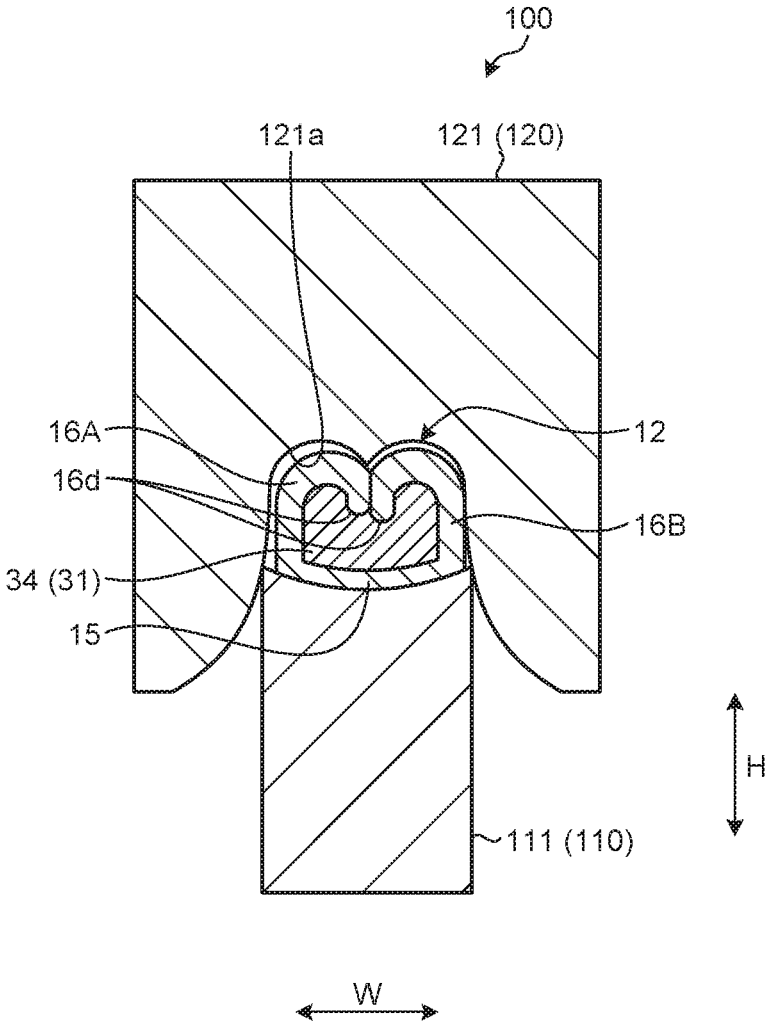
FIG. 14 is another sectional view illustrating a state when the second mold is at the bottom dead center.
Figure 15:
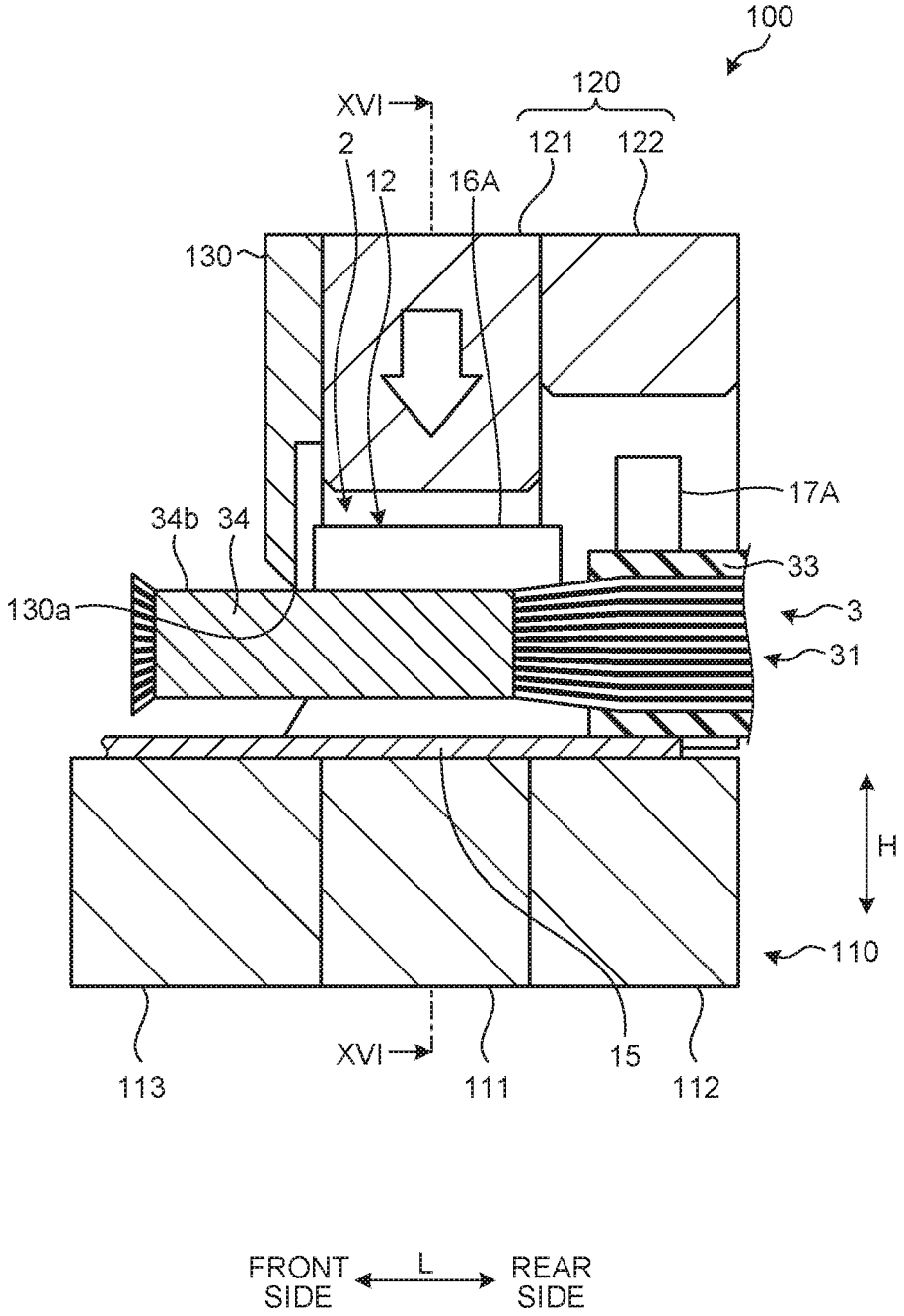
FIG. 15 is a sectional view for explaining a cutting process of the embodiment.
Figure 16:
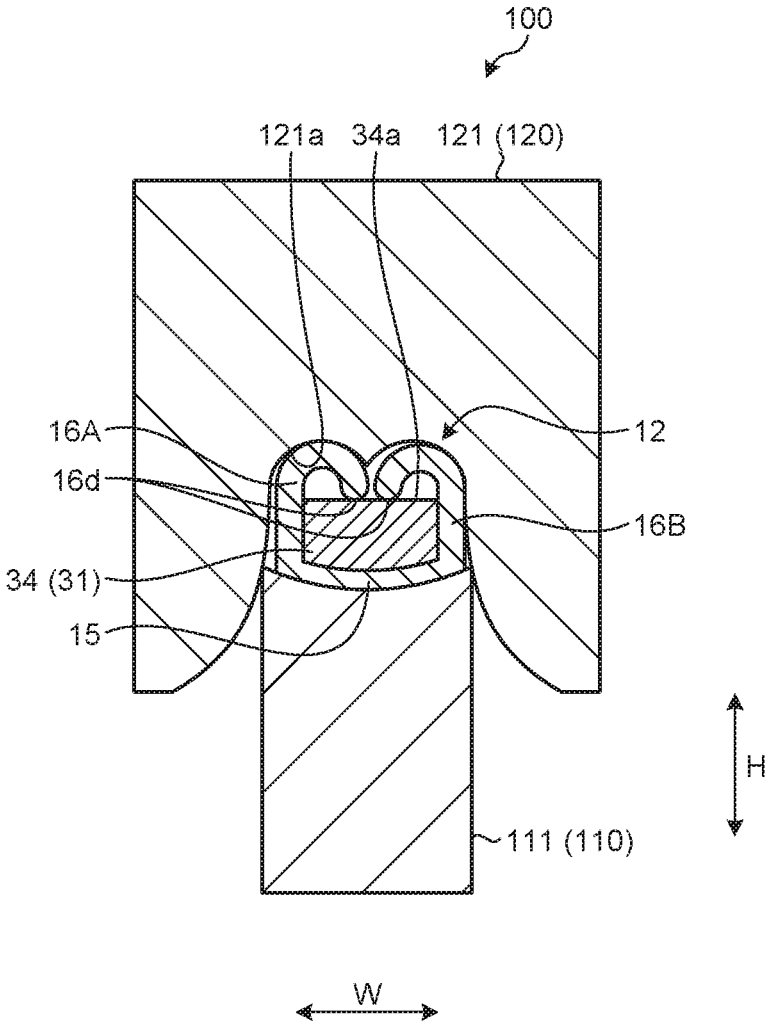
FIG. 16 is another sectional view for explaining the cutting process of the embodiment.
Figure 17:
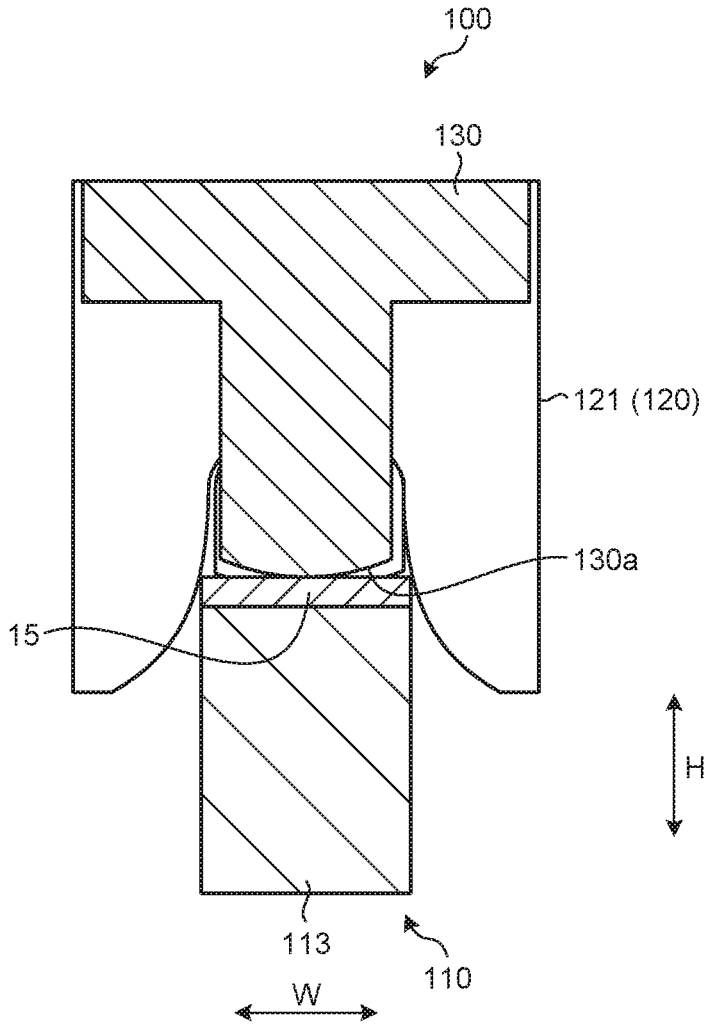
FIG. 17 is a sectional view of a state when the second mold is at the bottom dead center.
Figure 18:
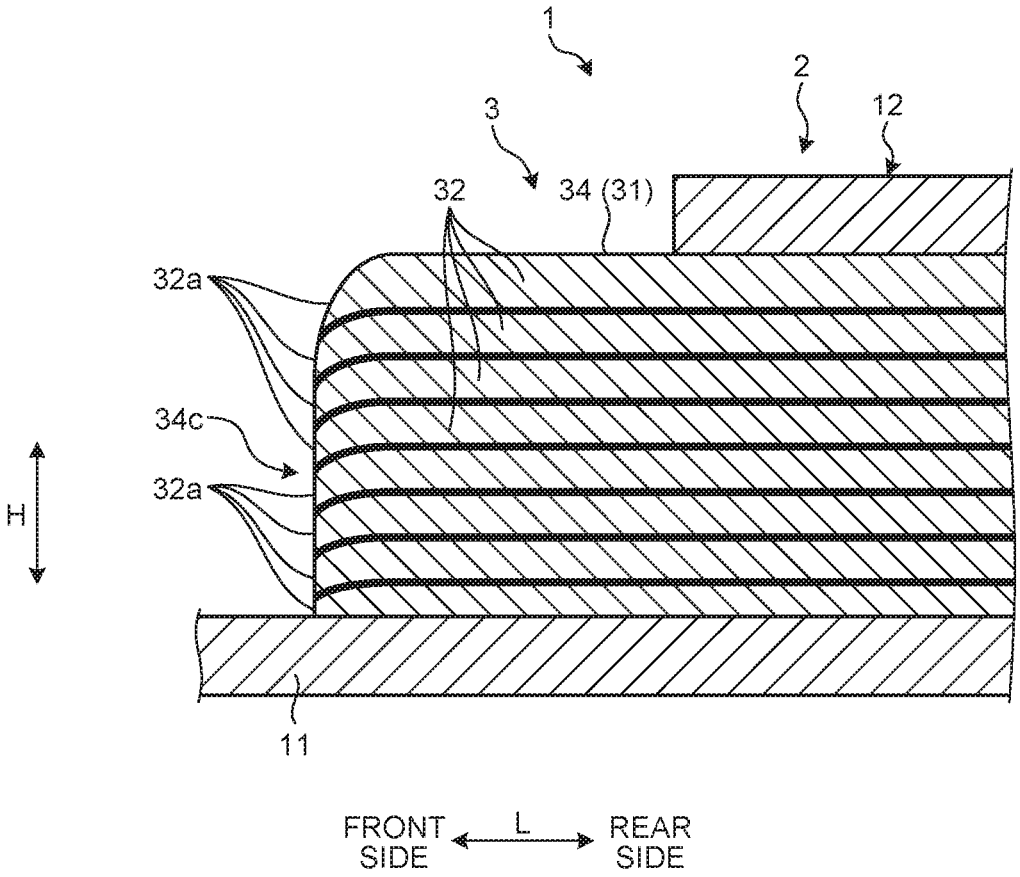
FIG. 18 is a sectional view illustrating a bonded part after being cut.

FIG. 11 is a sectional view for explaining a crimping process of the embodiment. FIG. 12 is another sectional view for explaining the crimping process of the embodiment. FIG. 13 is a sectional view illustrating a state when a second mold is at a bottom dead center. FIG. 14 is another sectional view illustrating a state when the second mold is at the bottom dead center. FIG. 15 is a sectional view for explaining a cutting process of the embodiment. FIG. 16 is another sectional view for explaining the cutting process of the embodiment. FIG. 17 is a sectional view of a state when the second mold is at the bottom dead center. FIG. 18 is a sectional view illustrating a bonded part after being cut.

FIG. 6 illustrates a cross section cut along the line VI-VI in FIG. 5. FIG. 8 illustrates a cross section cut along the line VIII-VIII in FIG. 7. FIG. 10 illustrates a cross section cut along the line X-X in FIG. 9. FIG. 12 illustrates a cross section cut along the line XII-XII in FIG. 11. FIG. 14 illustrates a cross section cut along the line XIV-XIV in FIG. 13. FIG. 17 illustrates a cross section cut along the line XVII-XVII in FIG. 13.

As illustrated in FIG. 1, an electric wire with a terminal 1 of the present embodiment includes a crimp terminal 2 and an electric wire 3. The crimp terminal 2 is a terminal crimped to the electric wire 3. The crimp terminal 2 is electrically connected to a counterpart terminal (not illustrated) while the crimp terminal 2 is integrally formed with the electric wire 3. In the electric wire 3 to be crimped, a covering 33 at the end portion is removed, and a core wire 31 is exposed as much as a predetermined length. The core wire 31 of the present embodiment is an assembly of a plurality of strands 32. The strands 32 are made of metal having conductivity such as copper and aluminum. The crimp terminal 2 is electrically connected to the exposed core wire 31, by crimping to the end portion of the electric wire 3.

The crimp terminal 2 is formed by a conductive metal plate (for example, a copper sheet and a copper alloy sheet) serving as a base material. The crimp terminal 2 is formed into a predetermined shape capable of connecting to the counterpart terminal and the electric wire 3 by performing a punching process, a bending process, or the like on the base material. The crimp terminal 2 includes a linking part 11, a core wire crimping part 12, a linking part 13, and a covering crimping part 14.

In the following explanation, the longitudinal direction of the crimp terminal 2 is referred to as a "first direction L". The first direction L is the insertion direction of the crimp terminal 2 and the counterpart terminal, and is also the axial direction of the electric wire 3. The width direction of the crimp terminal 2 is referred to as a "second direction W". The second direction W is a direction intersecting with the first direction L. A direction intersecting with the first direction L and the second direction W is referred to as a "third direction H". The third direction H is the height direction of the crimp terminal 2. The third direction H is a direction toward which the core wire crimping part 12 is pressed by a first mold 110 and a second mold 120 in the crimping process, which will be described below. In the first direction L, a tip end side of the core wire 31 is referred to as a "front side", and a side opposite to the front side is referred to as a "rear side".

The linking part 11, the core wire crimping part 12, the linking part 13, and the covering crimping part 14 are arranged along the first direction L in this order. The linking part 11 is disposed at the most front side in the crimp terminal 2. The core wire crimping part 12 is crimped to the core wire 31 of the electric wire 3. The covering crimping part 14 is crimped to the covering 33 of the electric wire 3. The core wire crimping part 12 and the covering crimping part 14 are connected via the linking part 13. The linking part 11 is extended toward the front side from the core wire crimping part 12. The core wire crimping part 12 includes a bottom part 15 and a pair of caulking pieces 16A and 16B (see FIG. 14). The pair of caulking pieces 16A and 16B are pieces extending from an end portion of the bottom part 15. Moreover, as illustrated in FIG. 1, the covering crimping part 14 includes a pair of caulking pieces 17A and 17B.

In the electric wire with a terminal 1 of the present embodiment, a bonded part 34 is formed in the core wire 31. The bonded part 34 is a portion in which the outer peripheral surfaces of the strands 32 are bonded to one another. The core wire crimping part 12 is crimped to the bonded part 34. Consequently, it is possible to reduce the electrical resistance between the strands 32, and the electrical resistance between the core wire 31 and the core wire crimping part 12.

Moreover, in the method for manufacturing the electric wire with a terminal 1, a cutting process of cutting the tip end of the bonded part 34 is performed in parallel with the crimping process. In other words, the bonded part 34 is surrounded by the caulking pieces 16A and 16B, and the tip end of the bonded part 34 is cut while the bonded part 34 is being compressed. Thus, it is possible to suppress the peeling off of the strands 32 and the cracking of the bonded part 34 while the bonded part 34 is being cut. As a result, it is possible to suppress the variations and reduction in the electrical performance of the electric wire with a terminal 1.

Hereinafter, the method for manufacturing the electric wire with a terminal according to the present embodiment will be described in detail. The method for manufacturing the electric wire with a terminal according to the present embodiment includes a removing process, a bonding process, an installation process, a crimping process, and a cutting process.

Removing Process

The removing process is a process of exposing the core wire 31 by removing a part of the covering 33 from the electric wire 3. FIG. 2 illustrates the electric wire 3 before a part of the covering 33 is removed. In the electric wire 3 illustrated in FIG. 2, the entire core wire 31 is covered by the covering 33 excluding the end surface of the core wire 31. As illustrated in FIG. 3, in the removing process, a tip end portion 33*a* of the covering 33 is removed from the electric wire 3. By removing the tip end portion 33*a*, an end portion 31*a* of the core wire 31 is exposed from the covering 33. In the electric wire 3 of the present embodiment, as illustrated in FIG. 4, the cross-sectional shape of the core wire 31 is a round shape. For example, the cross-sectional shape of each of the strands 32 is a round shape. However, the cross-sectional shape of the core wire 31 and the cross-sectional shape of the strand 32 are not limited to the round shape.

Bonding Process

The bonding process is a process of forming the bonded part 34 on the end portion 31*a* of the core wire 31. In the bonding process of the present embodiment, the bonded part 34 is formed by ultrasonic bonding. An ultrasonic bonder 20 is illustrated in FIG. 5 and FIG. 6. The ultrasonic bonder 20 includes a horn 21, an anvil plate 22, a grinding jaw 23, and a horn 24. For example, the horn 21, the anvil plate 22, the grinding jaw 23, and the horn 24 are plate-shaped members. A pressurizing surface 21*a* of the horn 21 and a pressurizing surface 24*a* of the anvil 24 are arranged in parallel. A pressurizing surface 22*a* of the anvil plate 22 and a pressuring surface 23*a* of the grinding jaw 23 are arranged in parallel. The pressurizing surfaces 21*a* and 24*a*, and the pressurizing surfaces 22*a* and 23*a* are perpendicular to one another.

The anvil 24 is movable relative to the horn 21 along a direction perpendicular to the pressurizing surfaces 21*a* and 24*a*. The grinding jaw 23 is movable relative to the anvil plate 22 along a direction perpendicular to the pressurizing surfaces 22*a* and 23*a*. The horn 21 is vibrated by an ultrasonic oscillator and vibrates ultrasonically. As illustrated in the arrow V1 in FIG. 6, the horn 21 vibrates along the axial direction of the electric wire 3.

The end portion 31*a* of the core wire 31 is inserted into a forming space 25 surrounded by the horn 21, the anvil plate 22, the grinding jaw 23, and the horn 24. The forming space 25 is a space portion the cross-sectional shape of which is rectangular.

As illustrated in FIG. 5, the ultrasonic bonder 20 compresses the end portion 31*a* by moving the anvil 24 toward the horn 21 (arrow F1), and moving the grinding jaw 23 toward the anvil plate 22 (arrow F2). In this process, the ultrasonic bonder 20 ultrasonically vibrates the horn 21. When the core wire 31 is compressed and vibrated, the strands 32 adjacent to one another are ultrasonically bonded. As a result, as illustrated in FIG. 7 and FIG. 8, the bonded part 34 is formed at the end portion 31*a* of the core wire 31. In the ultrasonic bonding, an oxide film formed on the surfaces of the strands 32 is destroyed, and the strands 32 adjacent to one another are metallically bonded to one another. In the bonded part 34, a gap between the strands 32 is reduced, and the outer peripheral surfaces of the strands 32 are bonded to one another. The cross-sectional area of the bonded part 34 becomes smaller than those of the other portions in the core wire 31.

In the present embodiment, as illustrated in FIG. 7, the bonded part 34 is formed in a section from the vicinity of the tip end of the end portion 31*a* of the core wire 31 to the vicinity of the covering 33. In other words, non-bonded parts 31*b* and 31*c* are left adjacent to the bonded part 34 at both ends of the end portion 31*a*. The non-bonded parts 31*b* and 31*c* are portions where the strands 32 are not bonded to one another. The non-bonded part 31*b* is a portion at the tip-end side of the end portion 31*a*, and is a portion exposed to the outside from the ultrasonic bonder 20 in the bonding process. The non-bonded part 31*c* is a portion at the base end side of the end portion 31*a*, and is a portion exposed to the outside from the ultrasonic bonder 20 in the bonding process. When the formation of the bonded part 34 is finished, the end portion 31*a* is taken out from the ultrasonic bonder 20.

Installation Process

The installation process is a process of installing the bonded part 34 onto the crimp terminal 2. In the installation process, the crimp terminal 2 and the electric wire 3 are installed on the first mold 110 of a terminal crimping device 100. As illustrated in FIG. 9 and FIG. 10, the terminal crimping device 100 includes the first mold 110, the second mold 120, and a cutting unit 130. The first mold 110 is a fixed mold, and supports the crimp terminal 2. The second mold 120 is a movable mold, and moves relative to the first mold 110 in the vertical direction.

As illustrated in FIG. 10, the first mold 110 includes a first anvil 111, a second anvil 112, and a third anvil 113. The first anvil 111 supports the core wire crimping part 12. The second anvil 112 supports the covering crimping part 14. The third anvil 113 supports the linking part 11 and a terminal connection part, which is not illustrated. The terminal connection part is a portion connected to the counterpart terminal in the crimp terminal 2. The terminal connection part is connected to the core wire crimping part 12 via the linking part 11.

The second mold 120 includes a first crimper 121 and a second crimper 122. The first crimper 121 faces the first anvil 111. The first crimper 121 crimps the core wire crimping part 12 to the core wire 31 by caulking the core wire crimping part 12. The second crimper 122 faces the second anvil 112. The second crimper 122 crimps the covering crimping part 14 to the covering 33 by caulking the covering crimping part 14.

The cutting unit 130 is a member for cutting the bonded part 34 of the core wire 31. The cutting unit 130 of the present embodiment is a cutting blade made of metal and the like. The cutting unit 130 is fixed to the front surface side of the first crimper 121. In other words, the cutting unit 130 is disposed on the end surface at the opposite side to the second crimper 122 side in the second mold 120. A blade tip 130*a* of the cutting unit 130 is a single blade. In other words, the surface of one side of the blade tip 130*a* is an inclined surface inclined toward one direction in the vertical direction. The inclined surface is inclined so as to come close to the first crimper 121 toward the tip end of the cutting unit 130. The other surface of the blade tip 130*a* is a surface parallel to the vertical direction. As illustrated in FIG. 9, the tip end of the blade tip 130*a* is slightly curved downward. The position of the blade tip 130*a* of the cutting unit 130 is set so that the cutting process can be performed in parallel with the crimping process.

In the installation process, the crimp terminal 2 is mounted on the upper surface of the first mold 110. As illustrated in FIG. 9 and FIG. 10, the core wire crimping part 12 of the crimp terminal 2 includes the bottom part 15, the first caulking piece 16A, and the second caulking piece 16B. The core wire crimping part 12 is formed in a U-shape. The bottom part 15 is a portion that becomes a bottom wall of the core wire crimping part 12 formed in a U-shape. The first caulking piece 16A and the second caulking piece 16B are portions that become side walls of the core wire crimping part 12 formed in a U-shape. The first caulking piece 16A extends from one end of the bottom part 15 in the second direction W. The second caulking piece 16B extends from the other end of the bottom part 15 in the second direction W.

Similarly to the core wire crimping part 12, the covering crimping part 14 includes the pair of caulking pieces 17A and 17B (see FIG. 1). The caulking pieces 17A and 17B of the covering crimping part 14 are formed away from the caulking pieces 16A and 16B of the core wire crimping part 12.

As illustrated in FIG. 10, the crimp terminal 2 is mounted on the first mold 110 so that the core wire crimping part 12 faces the first anvil 111, and the covering crimping part 14 faces the second anvil 112. More specifically, the crimp terminal 2 is mounted so that the bottom part 15 is supported by the first anvil 111, and the tip ends of the pair of caulking pieces 16A and 16B face the first crimper 121.

The electric wire 3 is installed onto the crimp terminal 2 supported by the first mold 110. The electric wire 3 is installed onto the crimp terminal 2 so that the end portion 31*a* of the core wire 31 faces the bottom part 15 of the core wire crimping part 12, and the covering 33 faces a bottom part 18 of the covering crimping part 14. More specifically, the electric wire 3 is installed onto the crimp terminal 2 so that the bonded part 34 faces the bottom part 15. In other words, the electric wire 3 is installed so that the bonded part 34 is positioned in the space portion surrounded by the bottom part 15 and the pair of caulking pieces 16A and 16B. In the installation process of the present embodiment, the electric wire 3 is installed so that a part of the bonded part 34 projects toward the front side from the core wire crimping part 12.

Crimping Process

The crimping process is a process of crimping the core wire crimping part 12 to the bonded part 34 of the core wire 31. In the crimping process of the present embodiment, the core wire crimping part 12 and the covering crimping part 14 are respectively crimped to the bonded part 34 and the covering 33. In the crimping process, the crimp terminal 2 and the electric wire 3 are sandwiched between the first mold 110 and the second mold 120. The first mold 110 and the second mold 120 crimp the caulking pieces 16A and 16B to the bonded part 34, and crimp the caulking pieces 17A and 17B to the covering 33. As illustrated in FIG. 11 and FIG. 12, in the crimping process, the second mold 120 moves downward to the first mold 110. The second mold 120 comes into contact with the crimp terminal 2 while the second mold 120 is moving downward. More specifically, as illustrated in FIG. 11, the first crimper 121 comes into contact with a tip end 16*d* of each of the caulking pieces 16A and 16B.

The first crimper 121 includes a curved surface 121*a* for deforming the caulking pieces 16A and 16B. The curved surface 121*a* deforms the caulking pieces 16A and 16B into a curved shape so that the tip end 16*d* of each of the caulking pieces 16A and 16B is oriented toward the first mold 110. The first crimper 121 deforms the caulking pieces 16A and 16B so that the bonded part 34 is covered by the pair of caulking pieces 16A and 16B, and the bottom part 15. FIG. 13 and FIG. 14 each illustrate a state when the second mold 120 is at the bottom dead center in the crimping process.

As illustrated in FIG. 14, the first crimper 121 of the present embodiment performs caulking referred to as what is called B crimp. The caulking pieces 16A and 16B are each curved so that the cross-sectional shape of the core wire crimping part 12 is formed in a B-shape. The tip end 16*d* of each of the caulking pieces 16A and 16B is oriented downward and pressed toward the bonded part 34. The caulking pieces 16A and 16B press the bonded part 34 toward the bottom part 15. Moreover, the caulking pieces 16A and 16B cover the bonded part 34, and compress the bonded part 34. It is to be noted that the caulking pieces 17A and 17B of the covering crimping part 14 are deformed similarly to the caulking pieces 16A and 16B, and are crimped to the covering 33.

Cutting Process

The cutting process is a process of cutting a tip end portion 34*b* of the bonded part 34 by the cutting unit 130. In the cutting process of the present embodiment, as will be described below, the cutting unit 130 cuts the bonded part 34 while the caulking pieces 16A and 16B are pressing the bonded part 34 toward the bottom part 15. In other words, the bonded part 34 is cut while the bonded part 34 is sandwiched between the caulking pieces 16A and 16B, and the bottom part 15.

FIG. 15 illustrates a cross section when the cutting unit 130 is about to cut the bonded part 34. As illustrated in FIG. 15, a part of the tip end portion 34*b* of the bonded part 34 projects toward the front side from the core wire crimping part 12. When the second mold 120 moves downward in the crimping process, the blade tip 130*a* of the cutting unit 130 comes into contact with the tip end portion 34*b* of the bonded part 34. The cutting unit 130 cuts the tip end portion 34*b* as the second mold 120 further moves downward. In the present embodiment, the caulking pieces 16A and 16B start pressing the bonded part 34 before the cutting unit 130 starts cutting the tip end portion 34*b*.

FIG. 16 illustrates a state when the caulking pieces 16A and 16B start pressing the bonded part 34. The tip end 16*d* of each of the caulking pieces 16A and 16B is brought into contact with an upper surface 34*a* of the bonded part 34, and presses the bonded part 34 toward the bottom part 15. In other words, the core wire crimping part 12 sandwiches the bonded part 34 at least in the third direction H, and compresses the bonded part 34. In the state illustrated in FIG. 16, it is preferable that the caulking pieces 16A and 16B further sandwich the bonded part 34 in the second direction W. When the bonded part 34 is sandwiched in the core wire crimping part 12, the peeling off of the strands 32 in the bonded part 34 or the like is suppressed. For example, the cracking of the bonded part 34 and the peeling off of the strands 32 are hard to occur at a portion at least covered by the core wire crimping part 12 in the bonded part 34.

The cutting unit 130 starts cutting the tip end portion 34*b* practically at the same time when the caulking pieces 16A and 16B start pressing the bonded part 34 toward the bottom part 15. Alternatively, the cutting unit 130 starts cutting the tip end portion 34*b* after the caulking pieces 16A and 16B start pressing the bonded part 34 toward the bottom part 15. Consequently, in the present embodiment, the cutting process is started while the core wire crimping part 12 is sandwiching the bonded part 34. Thus, the method for manufacturing the electric wire with a terminal according to the present embodiment is capable of cutting the bonded part 34 while suppressing the peeling off of the strands 32 and the cracking of the bonded part 34.

In the cutting process, stress to spread in the second direction W is generated in the bonded part 34, when the force in the third direction H is applied to the bonded part 34 by the cutting unit 130. To prevent stress from occurring, the caulking pieces 16A and 16B support the bonded part 34 from both sides in the second direction W, and restrict the deformation of the bonded part 34. Consequently, it is possible to effectively suppress the peeling off of the strands 32 and the cracking of the bonded part 34.

FIG. 13 and FIG. 17 each illustrate a state when the second mold 120 is moved downward to the bottom dead center. In this process, the blade tip 130*a* of the cutting unit 130 has reached the lower end of the bonded part 34, and the bonded part 34 is already cut. In other words, in the method for manufacturing the electric wire with a terminal according to the present embodiment, crimping of the core wire crimping part 12 to the bonded part 34 and cutting of the bonded part 34 are finished practically at the same time. Because the crimping process and the cutting process are carried out at the same time, the manufacturing method is simplified. Moreover, there is no need to provide a separate special device for cutting the tip end portion 34*b* of the bonded part 34 in addition to the terminal crimping device 100.

FIG. 18 illustrates a cross-section of the bonded part 34 after being cut by the cutting unit 130 in the cutting process. A tip end surface 34*c* of the bonded part 34 is a cut surface cut by the cutting unit 130. The tip end surface 34*c* projects to the outside from the core wire crimping part 12. In the cut surface of the tip end surface 34*c*, end surfaces 32*a* of the strands 32 are brought into contact with one another, and face the same direction. In other words, in the tip end surface 34*c*, the end surfaces 32*a* of the strands 32 are forming the cut surface as a single unit. In the electric wire with a terminal 1 illustrated in FIG. 18, each of the end surfaces 32*a* faces the front side. In the present embodiment, the bonded part 34 is cut perpendicularly by the cutting unit 130. In this case, each of the end surfaces 32*a* faces the first direction L.

The end surfaces 32*a* of the strands 32 forming the cut surface are sheared and deformed in the same direction. In the electric wire with a terminal 1 according to the present embodiment, the end surfaces 32*a* are sheared and deformed toward the linking part 11. The shear deformation direction is a direction according to the moving direction of the cutting unit 130. When the cutting unit 130 cuts the bonded part 34 by moving downward along the third direction H, the shear deformation direction is a downward direction along the third direction H.

As described above, the method for manufacturing the electric wire with a terminal according to the present embodiment includes the bonding process, the installation process, the crimping process, and the cutting process. The bonding process is the process of forming the bonded part 34 on the end portion 31*a* of the core wire 31 having the strands 32, in the electric wire 3 in which the end portion 31*a* is exposed from the covering 33. In the bonded part 34, the outer peripheral surfaces of the strands 32 are bonded to one another. The installation process is the process of installing the bonded part 34 onto the crimp terminal 2. The crimp terminal 2 includes the bottom part 15 and the pair of caulking pieces 16A and 16B that extend from the bottom part 15 and that face each other.

The crimping process is the process of sandwiching the crimp terminal 2 and the electric wire 3 between the first mold 110 and the second mold 120, and crimping the caulking pieces 16A and 16B to the bonded part 34. The first mold 110 is the mold for supporting the crimp terminal 2, and the second mold 120 is the mold that moves relative to the first mold 110.

The cutting process is the process of cutting the tip end portion 34*b* of the bonded part 34 by the cutting unit 130, while the caulking pieces 16A and 16B are pressing the bonded part 34 toward the bottom part 15. The tip end portion 34*b* to be cut is a portion projecting toward the outside from the caulking pieces 16A and 16B. With the method for manufacturing the electric wire with a terminal according to the present embodiment, the bonded part 34 is cut while the bonded part 34 is sandwiched between the caulking pieces 16A and 16B, and the bottom part 15. Consequently, it is possible to suppress the occurrence of cracking of the bonded part 34 and peeling off of the strands 32.

As a comparative example of the present embodiment, a manufacturing method in which the cutting process is performed before the crimping process, and the bonded part 34 is cut in advance will be considered. In this case, the bonded part 34 is cut while the bonded part 34 is not pressed by the surrounding parts. As a result, the bonded part 34 tends to crack and the strands 32 tend to peel off, while the bonded part 34 is being cut. On the other hand, with the method for manufacturing the electric wire with a terminal according to the present embodiment, it is possible to suppress the cracking of the bonded part 34 and the peeling off of the strands 32. As a result, it is possible to suppress the reduction in the electrical performance and variation in the electrical performance of the electric wire with a terminal 1.

Moreover, when the core wire crimping part 12 is crimped to the bonded part 34 after the cutting process is performed, the length of the bonded part 34 projecting from the core wire crimping part 12 tends to vary. On the other hand, with the method for manufacturing the electric wire with a terminal according to the present embodiment, the projecting length can be made uniform. Consequently, interference between the bonded part 34 and the other component is hard to occur when the electric wire with a terminal 1 is assembled to an electrical connection box and the like.

In the method for manufacturing the electric wire with a terminal according to the present embodiment, the second mold 120 and the cutting unit 130 are operated in an interlocking manner. In the present embodiment, a mode in which the second mold 120 and the cutting unit 130 integrally move in the vertical direction is described as a typical example. The cutting unit 130 may be directly fixed to the second mold 120, or may be indirectly fixed to the second mold 120 via another member.

In the method for manufacturing the electric wire with a terminal according to the present embodiment, the second mold 120 and the cutting unit 130 are integrally moved in the moving direction of the second mold 120, and crimping of the caulking pieces 16A and 16B to the bonded part 34 is performed in parallel with cutting of the tip end portion 34*b*. By performing the crimping process and the cutting process in parallel, it is possible to reduce the manufacturing time and simplify the manufacturing process.

The electric wire with a terminal 1 according to the present embodiment includes the electric wire 3 and the crimp terminal 2. The electric wire 3 includes the core wire 31 having the strands 32, and the covering 33 that covers the core wire 31 while the end portion 31*a* of the core wire 31 is being exposed. The crimp terminal 2 includes the core wire crimping part 12 crimped to the core wire 31. In the core wire 31, the portion at the tip end side including the portion crimped to the core wire crimping part 12 is the bonded part 34 in which the outer peripheral surfaces of the strands 32 are bonded to one another. The tip end surface 34*c* of the bonded part 34 projects to the outside from the core wire crimping part 12, and is the cut surface. In the cut surface of the tip end surface 34*c*, the end surfaces 32*a* of the strands 32 are brought into contact with one another, and face the same direction to form the cut surface. The tip end surface 34*c* as described above is formed by performing the cutting process of cutting the bonded part 34 and the crimping process in parallel, or performing the cutting process after the crimping process.

In the electric wire with a terminal 1 according to the present embodiment, the end surfaces 32*a* of the strands 32 that form the cut surface as described above are sheared and deformed toward the same direction. Such a cut surface is formed by performing the cutting process of cutting the bonded part 34 and the crimping process in parallel, or performing the cutting process after the crimping process.

Figure 19:
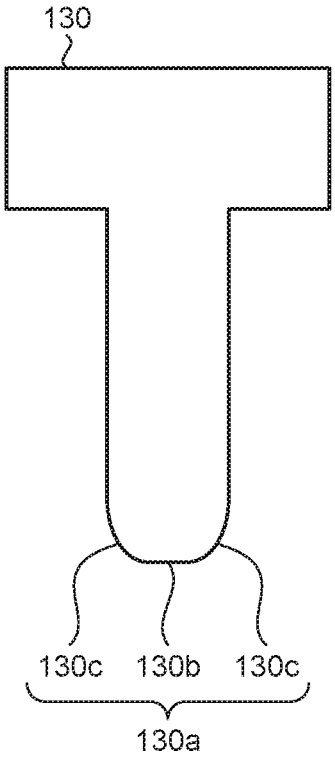
FIG. 19 is a plan view illustrating an example of the shape of a cutting unit.
Figure 20:
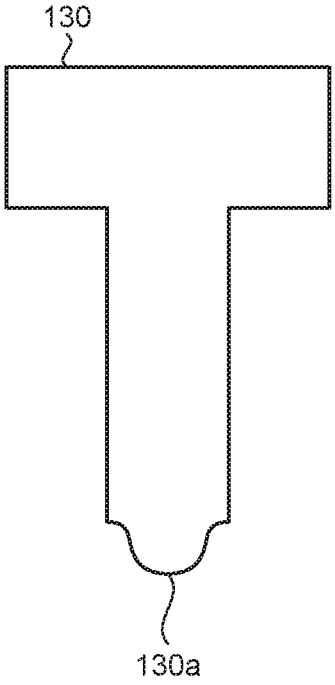
FIG. 20 is a plan view illustrating an example of the shape of the cutting unit.
Figure 21:
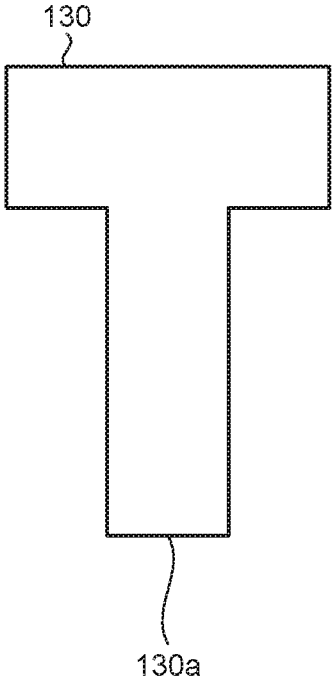
FIG. 21 is a plan view illustrating an example of the shape of the cutting unit.

The shape of the cutting unit 130 is not limited to the shape described in the example. FIG. 19 to FIG. 21 are each a plan view illustrating an example of the shape of the cutting unit 130. In the blade tip 130*a* of the cutting unit 130 illustrated in FIG. 19, a center portion 130*b* is formed in a linear shape, and both end portions 130*c* are curved in an arc shape. The blade tip 130*a* of the cutting unit 130 illustrated in FIG. 20 is formed in a curved shape the center portion of which is projected largely. The entire blade tip 130*a* of the cutting unit 130 illustrated in FIG. 21 is formed in a linear shape. The shape of the blade tip 130*a* is suitably defined according to the cross-sectional shape of the core wire crimping part 12 and the cross-sectional shape of the bonded part 34. For example, the blade tip 130*a* may be shaped along the cross-sectional shape of the bottom part 15.

Figure 22:
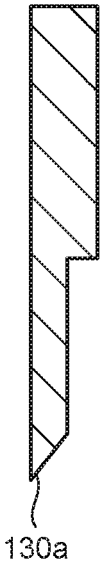
FIG. 22 is a sectional view illustrating an example of the shape of the cutting unit.
Figure 23:
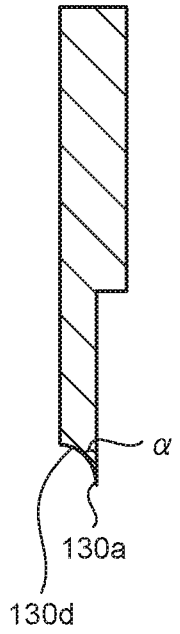
FIG. 23 is a sectional view illustrating an example of the shape of the cutting unit.
Figure 24:
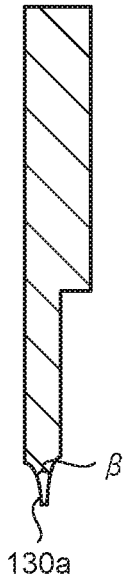
FIG. 24 is a sectional view illustrating an example of the shape of the cutting unit.
Figure 25:
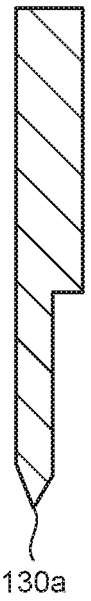
FIG. 25 is a sectional view illustrating an example of the shape of the cutting unit.
Figure 26:
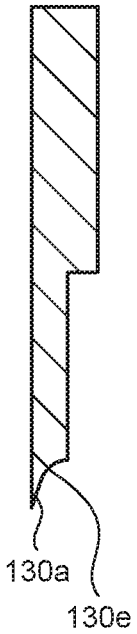
FIG. 26 is a sectional view illustrating an example of the shape of the cutting unit.

FIG. 22 to FIG. 26 are each a sectional view illustrating an example of the shape of the cutting unit 130. In the cutting unit 130 illustrated in FIG. 22, the inclination of the blade tip 130*a* is opposite from the inclination of the blade tip 130*a* illustrated in FIG. 10. In other words, the inclination surface of the blade tip 130*a* illustrated in FIG. 22 is inclined so as to separate from the second mold 120 toward the tip end. In the blade tip 130*a* illustrated in FIG. 23, a curved surface 130*d* is formed at one side so that an angle $\alpha$ at the blade tip is reduced toward the tip end. In the blade tip 130*a* illustrated in FIG. 24, the curved surfaces are formed on both sides so that an angle $\beta$ at the blade tip is reduced toward the tip end. In the blade tip 130*a* illustrated in FIG. 25, the inclination surfaces are formed on both sides. In the blade tip 130*a* illustrated in FIG. 26, a curved surface 130*e* is formed on the opposite side to the blade tip 130*a* illustrated in FIG. 23.

First Modification of Embodiment

Figure 27:
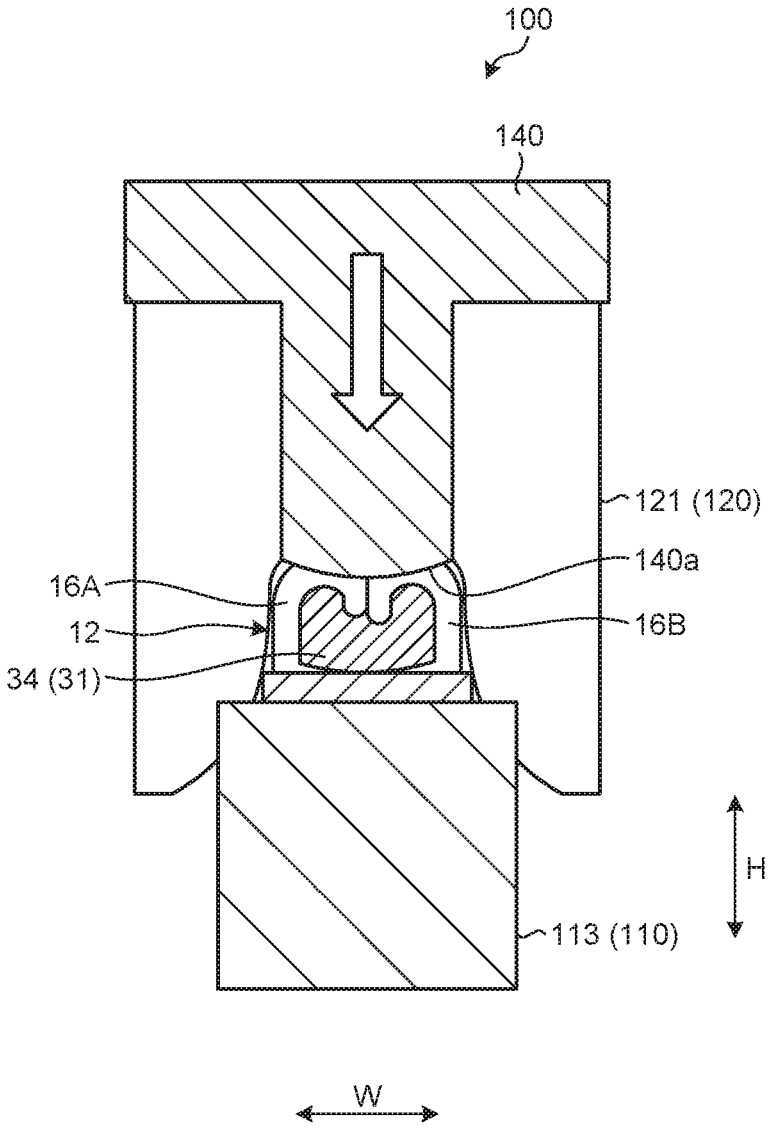
FIG. 27 is a sectional view for explaining a cutting process according to a first modification of the embodiment.
Figure 28:
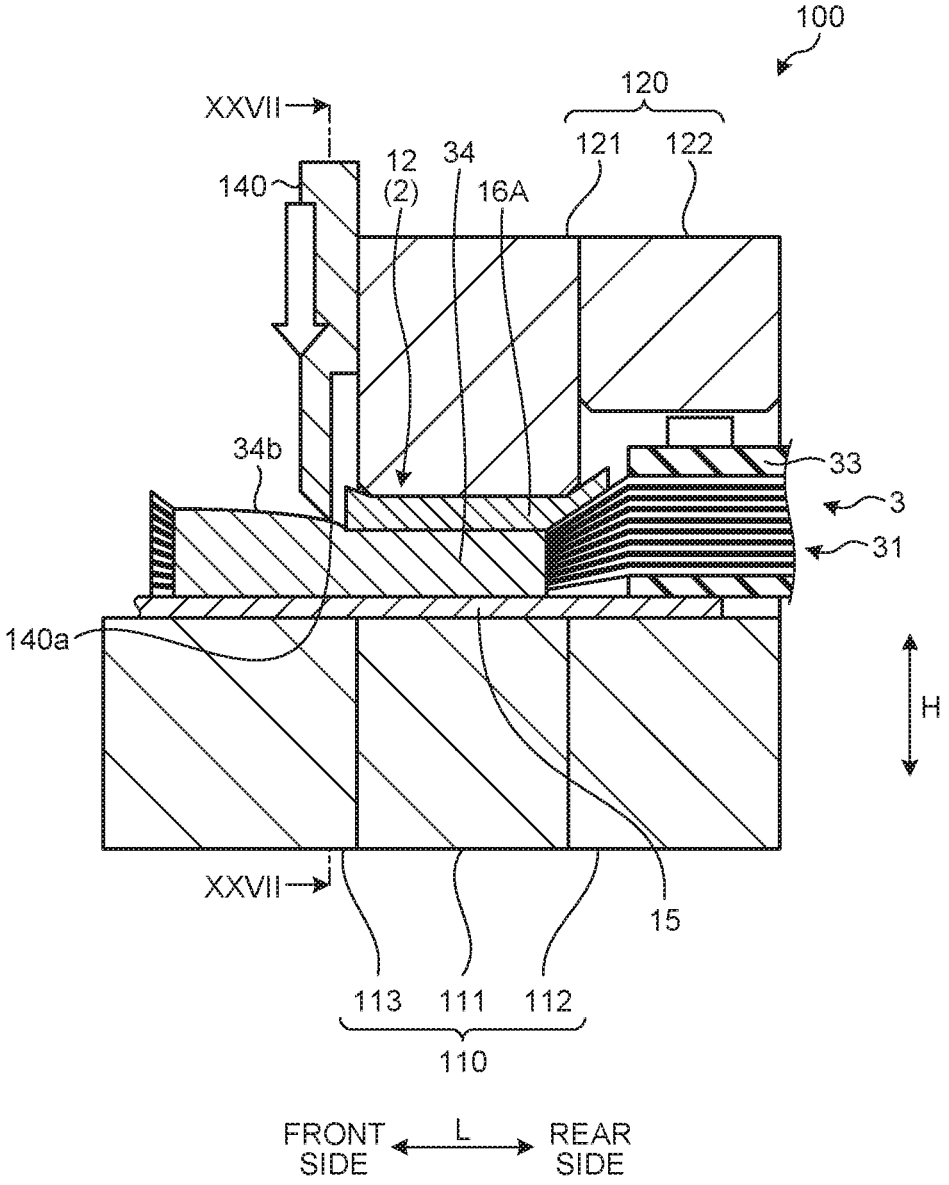
FIG. 28 is another sectional view for explaining the cutting process according to the first modification of the embodiment.

A first modification of the embodiment will now be described with reference to FIG. 27 and FIG. 28. FIG. 27 is a sectional view for explaining a cutting process according to a first modification of the embodiment. FIG. 28 is another sectional view for explaining the cutting process according to the first modification of the embodiment. FIG. 27 illustrates a cross-section cut along the line XXVII-XXVII in FIG. 28. For example, the first modification of the embodiment differs from the embodiment described above in cutting the bonded part 34 while the terminal crimping device 100 is holding the second mold 120 at the bottom dead center.

A cutting unit 140 illustrated in FIG. 27 and FIG. 28 is movable relative to the second mold 120. The terminal crimping device 100 operates the second mold 120 and the cutting unit 140 in an interlocking manner. A mechanism for operating the second mold 120 and a mechanism for operating the cutting unit 140 may be the same or may be independent from each other. The terminal crimping device 100 cuts the bonded part 34 by moving the cutting unit 140 downward while the second mold 120 is stopped at the bottom dead center. FIG. 27 and FIG. 28 each illustrate a state when the second mold 120 is stopped at the bottom dead center. The cutting unit 140 moves downward to the bonded part 34. From this state, the terminal crimping device 100 further moves the cutting unit 140 downward, and cuts the bonded part 34 by the cutting unit 140. For example, the shape of a blade tip 140*a* of the cutting unit 140 is the same as that of the blade tip 130*a* of the embodiment described above.

In the first modification of the embodiment, the cutting process is started while the core wire crimping part 12 is firmly holding the bonded part 34. Consequently, with the method for manufacturing the electric wire with a terminal according to the first modification of the embodiment, the peeling off of the strands 32 and the cracking of the bonded part 34 are hard to occur.

Second Modification of Embodiment

Figure 29:
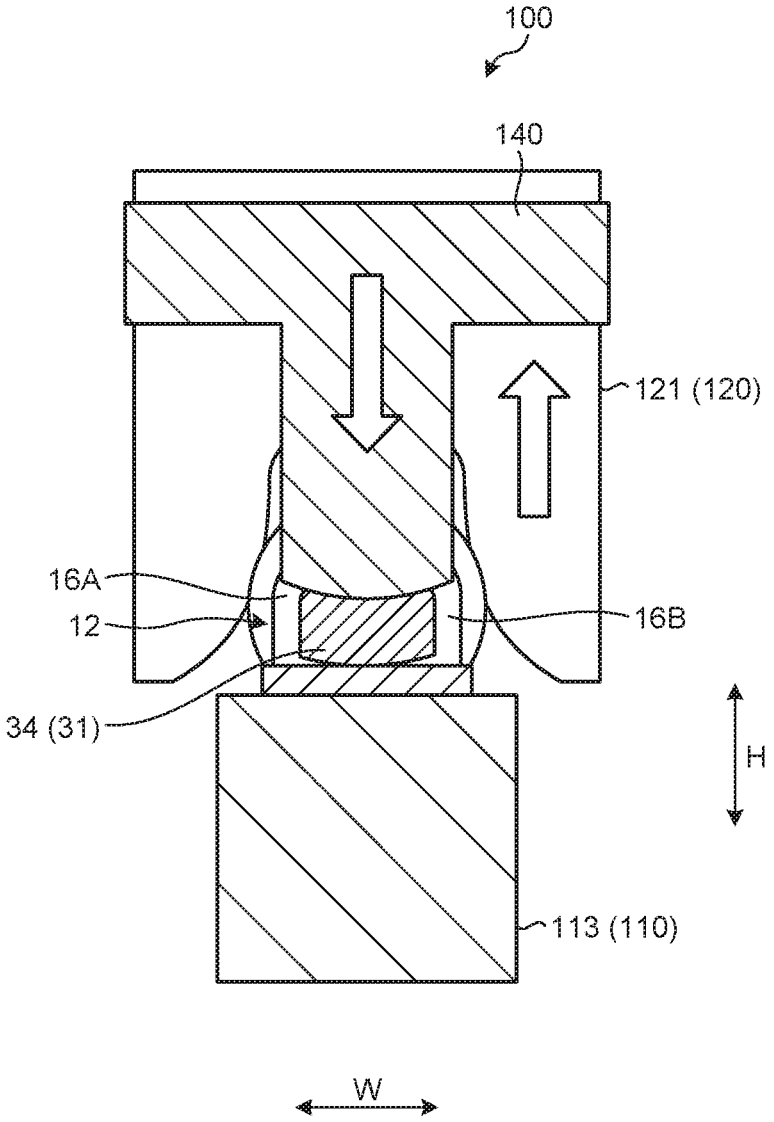
FIG. 29 is a sectional view for explaining a cutting process according to a second modification of the embodiment.
Figure 30:
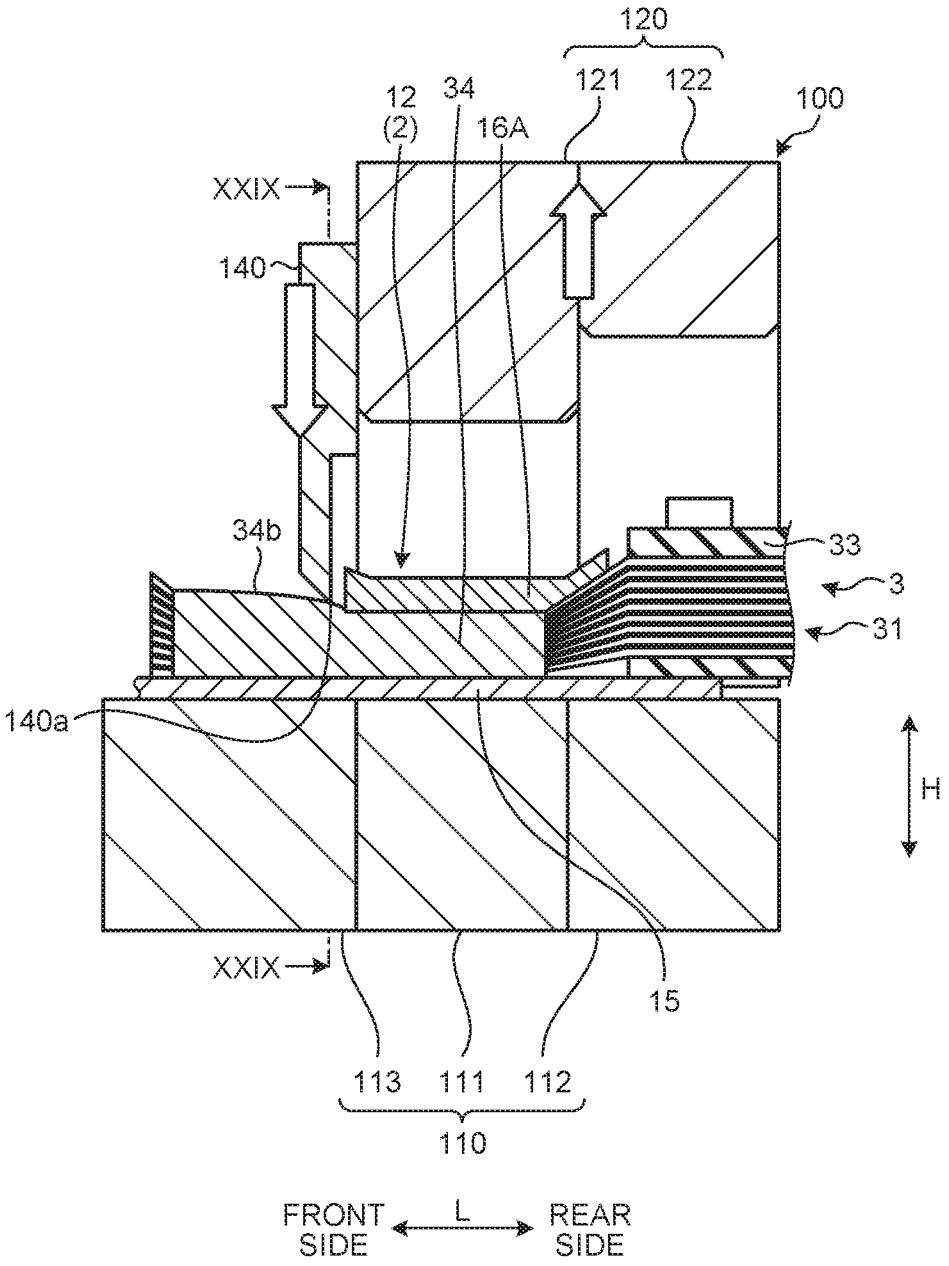
FIG. 30 is another sectional view for explaining the cutting process according to the second modification of the embodiment.

A second modification of the embodiment will now be described with reference to FIG. 29 and FIG. 30. FIG. 29 is a sectional view for explaining a cutting process according to the second modification of the embodiment. FIG. 30 is another sectional view for explaining the cutting process according to the second modification of the embodiment. FIG. 29 illustrates a cross-section cut along the line XXIX-XXIX in FIG. 30. For example, the second modification of the embodiment differs from the embodiment described above in cutting the bonded part 34 while the terminal crimping device 100 is moving the second mold 120 upward.

Similarly to the cutting unit 140 according to the first modification described above, the cutting unit 140 according to the second modification of the embodiment is capable of moving relative to the second mold 120. The terminal crimping device 100 cuts the bonded part 34 by the cutting unit 140 after the second mold 120 reaches the bottom dead center. In the cutting process according to the second modification, the terminal crimping device 100 does not stop the second mold 120 at the bottom dead center, but moves the second mold 120 upward. In other words, in the cutting process, as illustrated in FIG. 29 and FIG. 30, the second mold 120 moves upward and the cutting unit 140 moves downward.

In the second modification of the embodiment, similarly to the first modification, the cutting process is started while the core wire crimping part 12 is firmly holding the bonded part 34. Consequently, the peeling off of the strands 32 and the cracking of the bonded part 34 are hard to occur in the cutting process.

Third Modification of Embodiment

Figure 31:
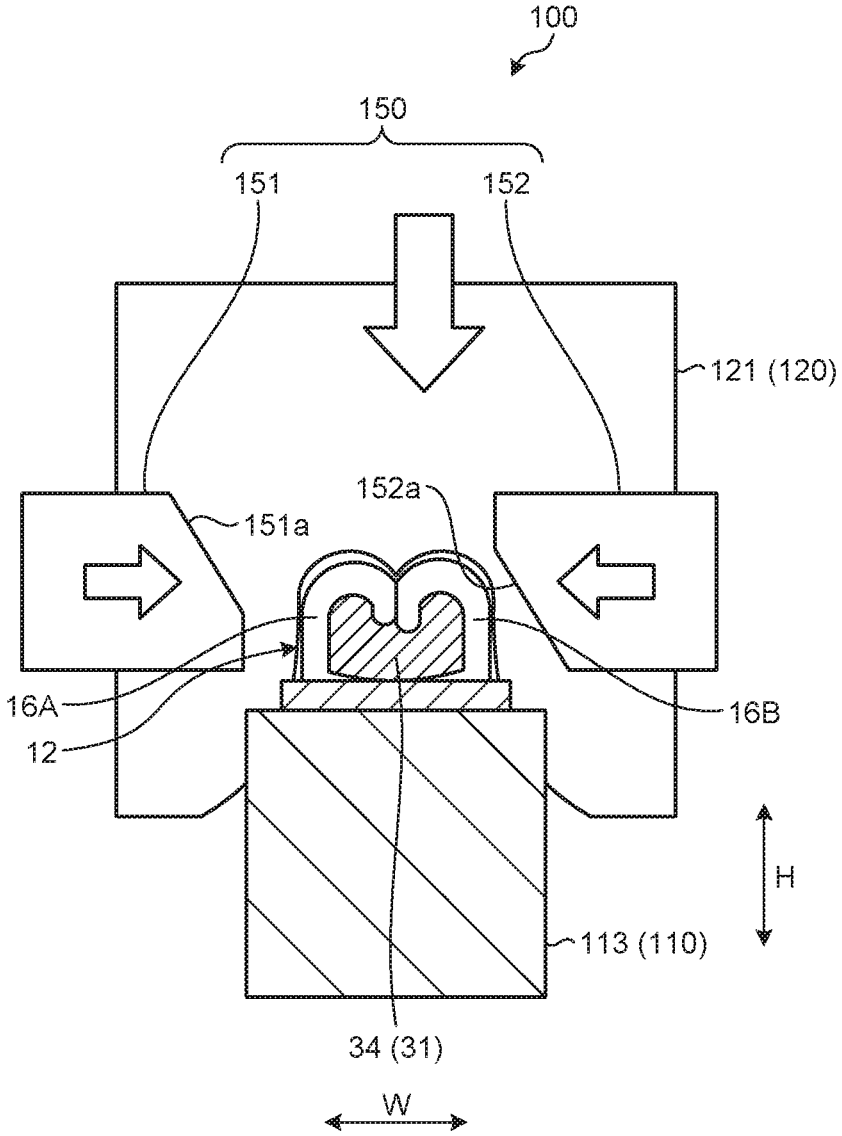
FIG. 31 is a sectional view for explaining a cutting process according to a third modification of the embodiment.
Figure 32:
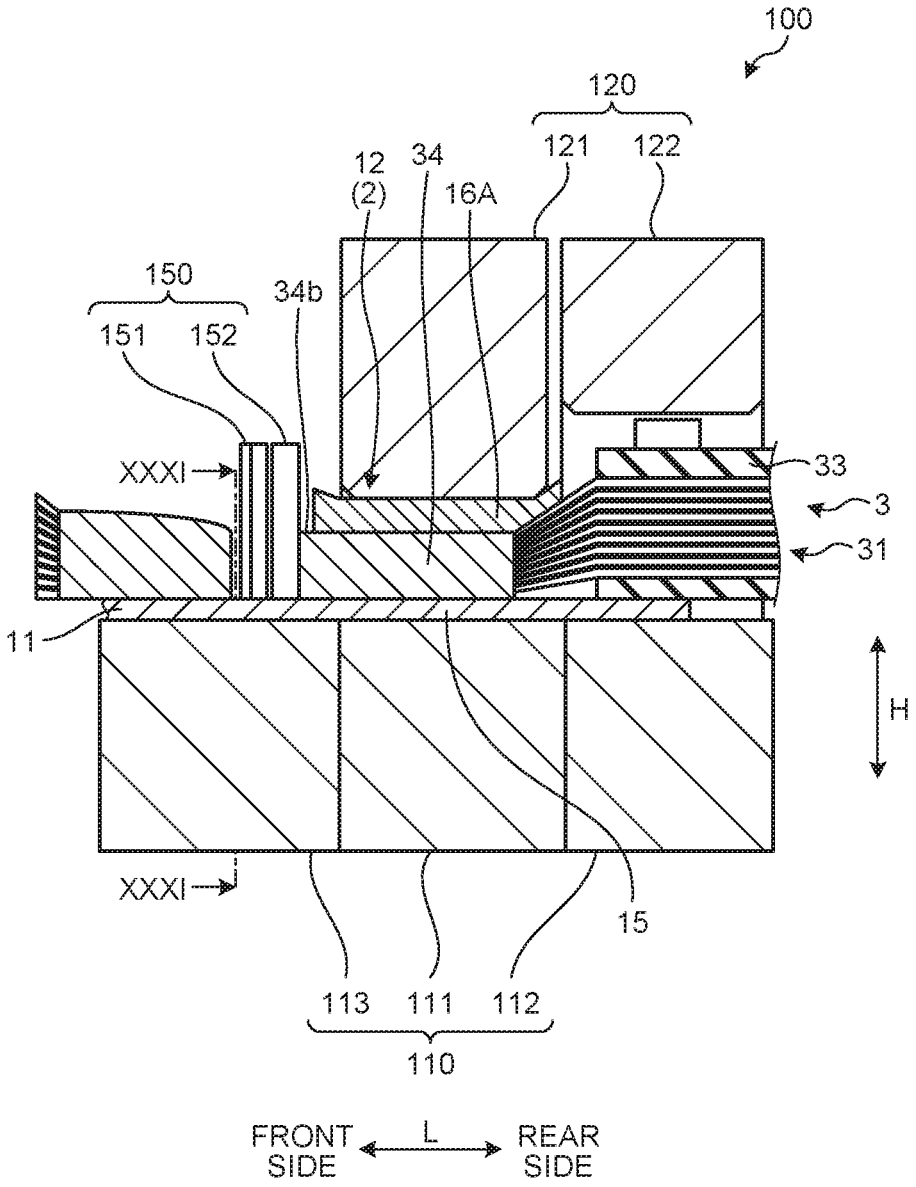
FIG. 32 is another sectional view for explaining the cutting process according to the third modification of the embodiment.
Figure 33:
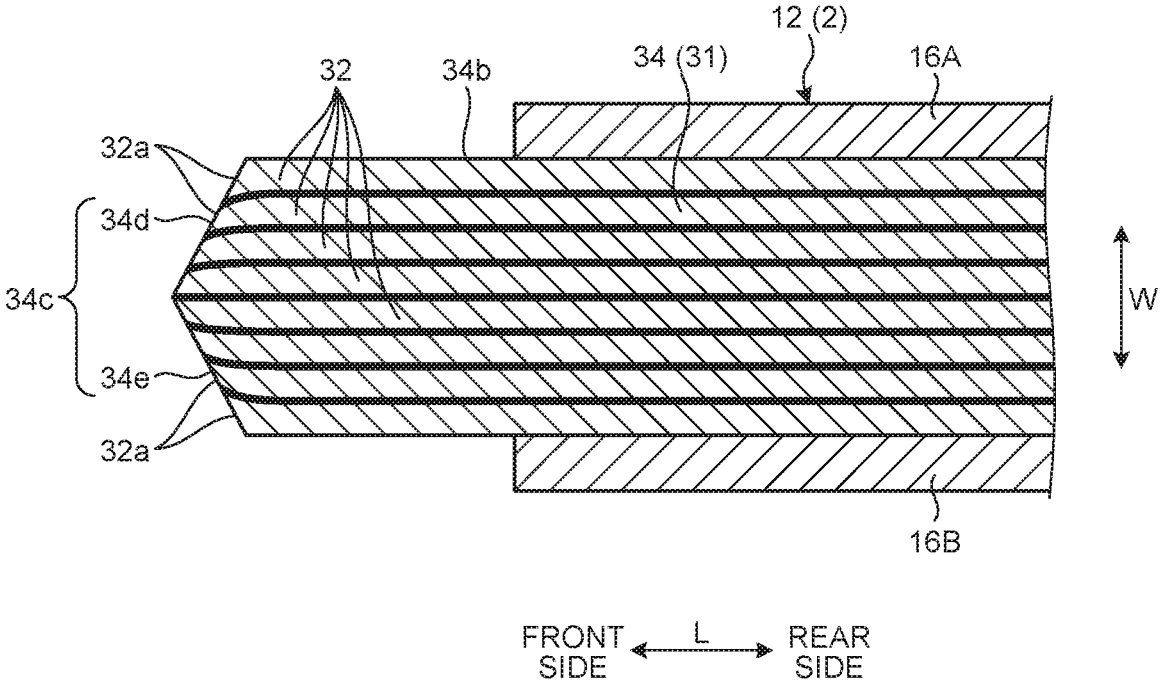
FIG. 33 is a sectional view illustrating an electric wire with a terminal according to the third modification of the embodiment.

A third modification of the embodiment will now be described with reference to FIG. 31 and FIG. 32. FIG. 31 is a sectional view for explaining a cutting process according to the third modification of the embodiment. FIG. 32 is another sectional view for explaining the cutting process according to the third modification of the embodiment. FIG. 33 is a sectional view illustrating the bonded part after being cut. FIG. 31 illustrates a cross-section cut along the line XXXI-XXXI in FIG. 32. For example, the third modification of the embodiment differs from the embodiment described above in that a cutting unit 150 cuts the bonded part 34 while moving in the second direction W.

The cutting unit 150 according to the third modification of the embodiment includes a first cutting unit 151 and a second cutting unit 152. The first cutting unit 151 and the second cutting unit 152 each move in the second direction W. The terminal crimping device 100 operates the second mold 120 and the cutting unit 150 in an interlocking manner. A mechanism for operating the second mold 120 and a mechanism for operating the cutting unit 150 may be the same or may be independent from each other. The two cutting units 151 and 152 move in the opposite directions along the second direction W. The first cutting unit 151 and the second cutting unit 152 are arranged shifted in the first direction L. A blade tip 151*a* of the first cutting unit 151 and a blade tip 152*a* of the second cutting unit 152 face each other in the second direction W. The cutting unit 150 sandwiches the bonded part 34 between the blade tip 151*a* of the first cutting unit 151 and the blade tip 152*a* of the second cutting unit 152, and cuts the bonded part 34 by the shearing force.

For example, the cutting unit 150 cuts the bonded part 34 in parallel with the crimping process. In this case, it is preferable that the cutting unit 150 starts cutting the bonded part 34 after the caulking pieces 16A and 16B start pressing the bonded part 34 toward the bottom part 15. FIG. 31 illustrates a state when the cutting unit 150 starts cutting the bonded part 34 while the second mold 120 is moved downward. FIG. 32 illustrates a state when the bonded part 34 is cut by the cutting unit 150.

FIG. 33 illustrates a cross-section of the bonded part 34 cut by the cutting unit 150. The cross-section in FIG. 33 is a cross-section perpendicular to the third direction H. The tip end surface 34*c* of the bonded part 34 includes two cut surfaces 34*d* and 34*e*. The cut surface 34*d* is a cut surface formed by the first cutting unit 151. The other cut surface 34*e* is a cut surface formed by the second cutting unit 152. In the cut surface 34*d*, the end surfaces 32*a* of the strands 32 are brought into contact with one another and face the same direction, thereby forming the cut surface 34*d*. In the other cut surface 34*e*, the end surfaces 32*a* of the strands 32 are brought into contact with one another and face the same direction, thereby forming cut surface 34*e*.

The end surfaces 32*a* of the strands 32 that form the cut surface 34*d* are sheared and deformed toward the same direction. The shear deformation direction is a direction toward the center of the core wire 31 in the second direction W. The end surfaces 32*a* of the strands 32 that form the cut surface 34*e* are sheared and deformed in the same direction. The shear deformation direction is a direction toward the center of the core wire 31 in the second direction W.

It is to be noted that the cutting unit 150 may also cut the bonded part 34 after the crimping process is completed. In this case, the terminal crimping device 100 may cut the bonded part 34 by the cutting unit 150 while the second mold 120 is stopped at the bottom dead center, or may cut the bonded part 34 by the cutting unit 150 while the second mold 120 is being moved upward.

The shape of the first cutting unit 151 and the shape of the second cutting unit 152 may be symmetrical or asymmetrical. Moreover, the operation of the first cutting unit 151 and the operation of the second cutting unit 152 may be symmetrical or asymmetrical.

Fourth Modification of Embodiment

Figure 34:
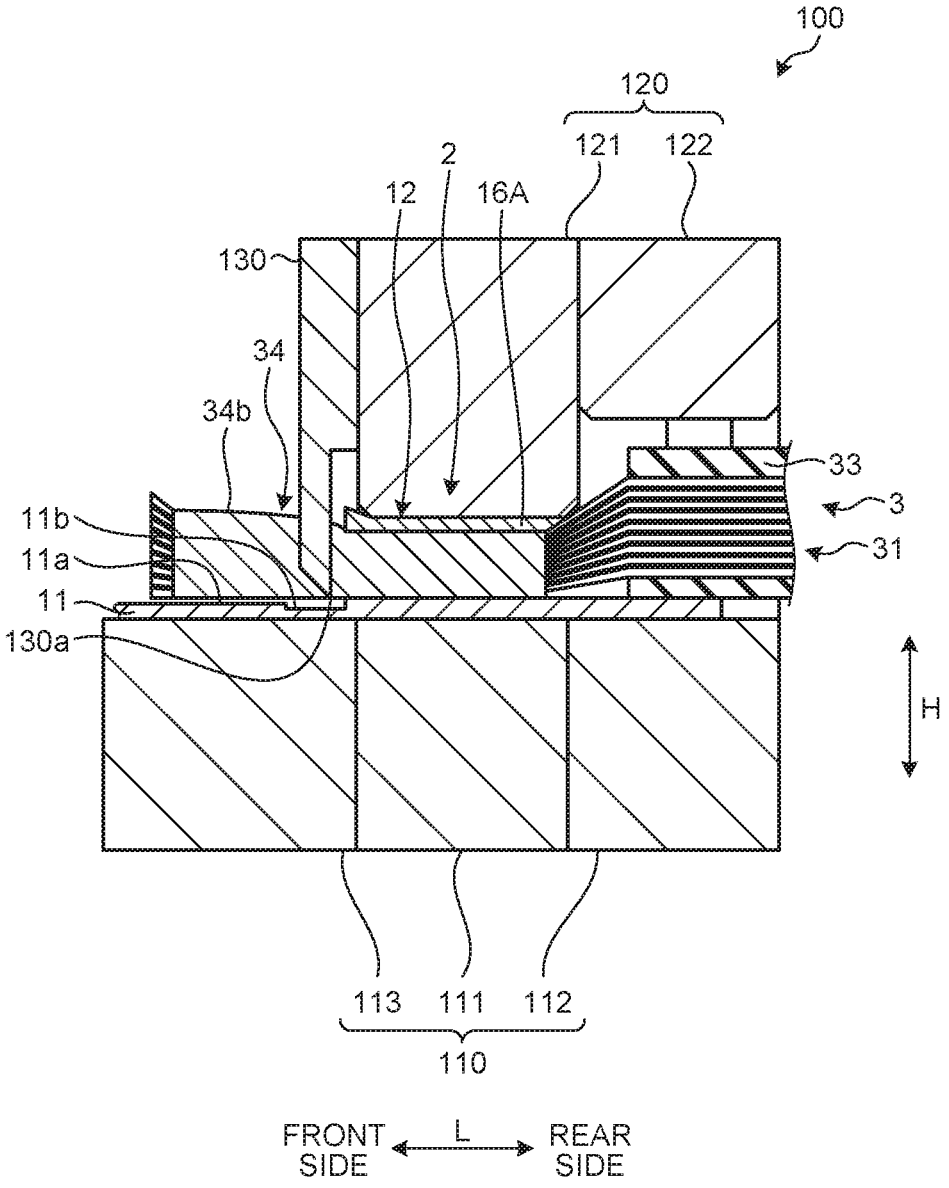
FIG. 34 is a sectional view for explaining a cutting process according to a fourth modification of the embodiment.

A fourth modification of the embodiment will now be described with reference to FIG. 34. FIG. 34 is a sectional view for explaining a cutting process according to the fourth modification of the embodiment. For example, the fourth modification of the embodiment differs from the embodiment described above in that the crimp terminal 2 has a concave portion 11*b* and that the concave portion 11*b* is disposed facing the cutting unit 130.

As illustrated in FIG. 34, the concave portion 11*b* is formed in the linking part 11 of the crimp terminal 2. The linking part 11 is a wall portion adjacent to the bottom part 15 in the first direction L, and is supported by the first mold 110. The concave portion 11*b* is formed in a facing surface 11*a* of the linking part 11. The facing surface 11*a* is a surface facing the tip end portion 34*b* of the bonded part 34 between the two surfaces of the linking part 11. In other words, in the linking part 11, the facing surface 11*a* is a surface facing opposite to the first mold 110 side when the linking part 11 is mounted on the first mold 110.

The concave portion 11*b* is recessed toward the first mold 110 side. The concave portion 11*b* is a groove portion formed in the facing surface 11*a* and extends in the second direction W. In the second direction W, a range where the concave portion 11*b* is formed is a range facing the blade tip 130*a* of the cutting unit 130.

The crimp terminal 2 is mounted on the first mold 110 so that the concave portion 11*b* faces the cutting unit 130 in the third direction H. Consequently, in the cutting process, the terminal crimping device 100 cuts the tip end portion 34*b*, by moving the cutting unit 130 toward the concave portion 11*b* along the third direction H. By making the concave portion 11*b* facing the cutting unit 130, it is possible to suppress interference between the crimp terminal 2 and the cutting unit 130. Thus, the facing surface 11*a* of the crimp terminal 2 is hard to be scratched. Moreover, it is possible to suppress abrasion of the blade tip 130*a* of the cutting unit 130.

Figure 35:
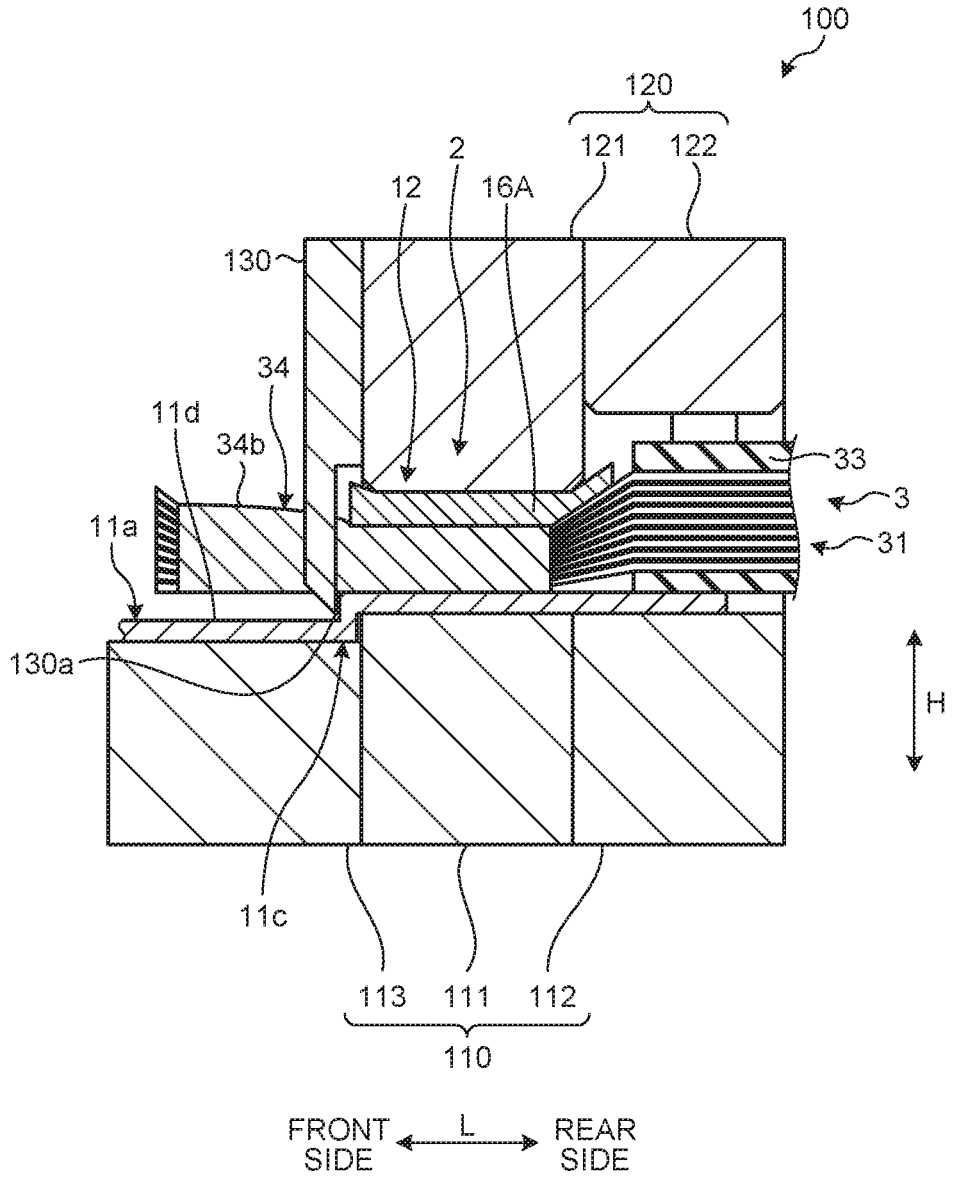
FIG. 35 is another sectional view for explaining the cutting process according to the fourth modification of the embodiment.

FIG. 35 is another sectional view for explaining the cutting process according to the fourth modification of the embodiment. In the crimp terminal 2 illustrated in FIG. 35, a step portion 11*c* is provided on the linking part 11. The linking part 11 is bent so that a portion at the front side of the step portion 11*c* is placed a step lower than a portion at the rear side of the step portion 11*c*. By forming the step portion 11*c*, a concave portion 11*d* is provided in the facing surface 11*a*.

The crimp terminal 2 is mounted on the first mold 110 so that the concave portion 11*d* faces the cutting unit 130 in the third direction H. In response to forming the step portion 11*c* on the linking part 11, the position of the upper surface of the third anvil 113 becomes lower than the position of the upper surface of the first anvil 111. For example, the crimp terminal 2 is mounted so that the vicinity of the step portion 11*c* in the concave portion 11*d* faces the cutting unit 130. In the cutting process, the terminal crimping device 100 cuts the tip end portion 34*b* by moving the cutting unit 130 toward the concave portion 11*d* in the third direction H.

Figure 36:
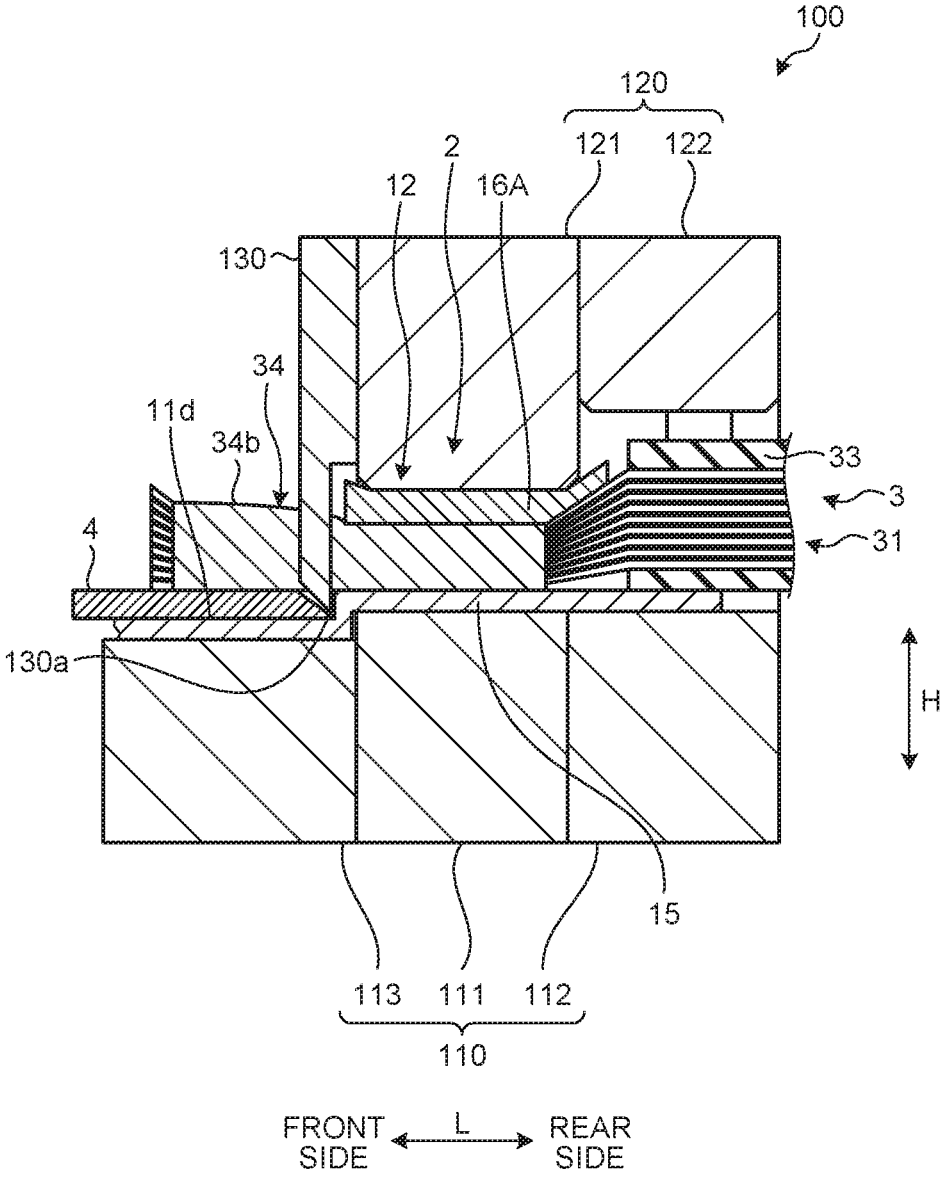
FIG. 36 is another sectional view for explaining the cutting process according to the fourth modification of the embodiment.
Figure 37:
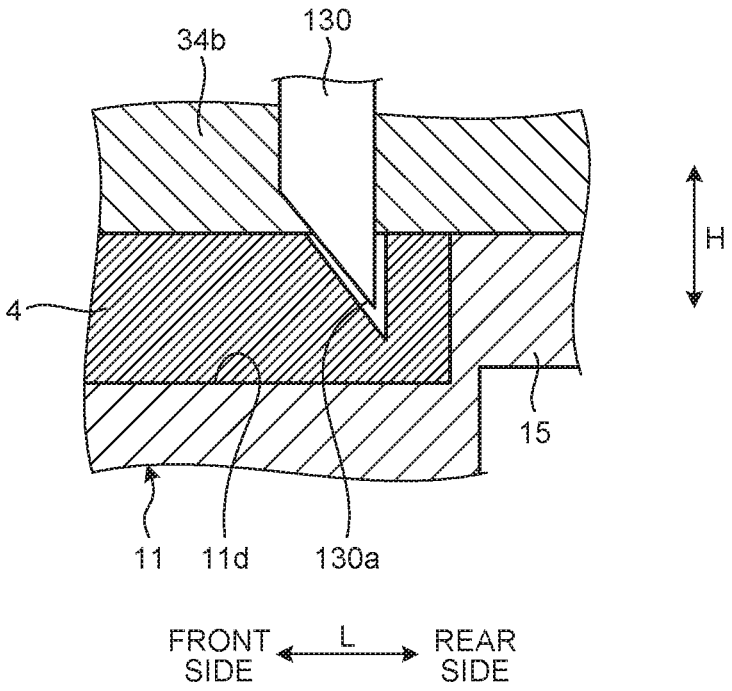
FIG. 37 is an enlarged view of a main part of FIG. 36.

FIG. 36 is another sectional view for explaining the cutting process according to the fourth modification of the embodiment. FIG. 37 is an enlarged view of a main part of FIG. 36. In the crimp terminal 2 illustrated in FIG. 36, a protection member 4 is provided in the concave portion 11*d*. For example, the protection member 4 is formed of a material the rigidity of which is smaller than that of the material of the linking part 11. The protection member 4 illustrated in FIG. 36 is a plate-shaped member, and is fixed to the concave portion 11*d* by adhesion or the like. The thickness of the protection member 4 is the same as the depth of the concave portion 11*d*. In other words, the upper surface of the bottom part 15 and the upper surface of the protection member 4 are on the same surface.

The crimp terminal 2 is mounted on the first mold 110 so that the protection member 4 faces the cutting unit 130 in the third direction H. The protection member 4 supports the tip end portion 34*b* of the bonded part 34 from below. In the cutting process, the terminal crimping device 100 cuts the tip end portion 34*b* by moving the cutting unit 130 toward the protection member 4 in the third direction H. In the cutting process, the protection member 4 protects the linking part 11 from coming into contact with the cutting unit 130.

For example, the cutting unit 130 is set so that the blade tip 130*a* cuts halfway through the protection member 4 in the third direction H. Consequently, as illustrated in FIG. 37, when the second mold 120 is moved downward to the bottom dead center, the blade tip 130*a* does not reach the linking part 11. Because the blade tip 130*a* is inserted below the upper surface of the protection member 4, it is possible to cut the lower end of the bonded part 34 without fail. Moreover, because the protection member 4 is supporting the bonded part 34, the cutting unit 130 can stably cut the bonded part 34.

As described above, the crimp terminal 2 of the fourth modification of the embodiment includes the linking part 11 that is adjacent to the bottom part 15 and that is supported by the first mold 110. In the linking part 11, the facing surface 11*a* facing the tip end portion 34*b* has the concave portion 11*b* recessed toward the first mold 110 side. The crimp terminal 2 is mounted on the first mold 110 so that the concave portion 11*b* faces the cutting unit 130. In the cutting process, the tip end portion 34*b* is cut by moving the cutting unit 130 toward the concave portion 11*b* in the moving direction of the second mold 120. Consequently, the method for manufacturing the electric wire with a terminal according to the fourth modification is capable of cutting the tip end portion 34*b* while suppressing the interference between the cutting unit 130 and the crimp terminal 2.

The crimp terminal 2 may also include the protection member 4 disposed in the concave portion 11*d*, and mounted on the first mold 110 so that the protection member 4 faces the cutting unit 130. In this manner, it is possible to further suppress the interference between the cutting unit 130 and the crimp terminal 2 without fail.

Fifth Modification of Embodiment

Figure 38:
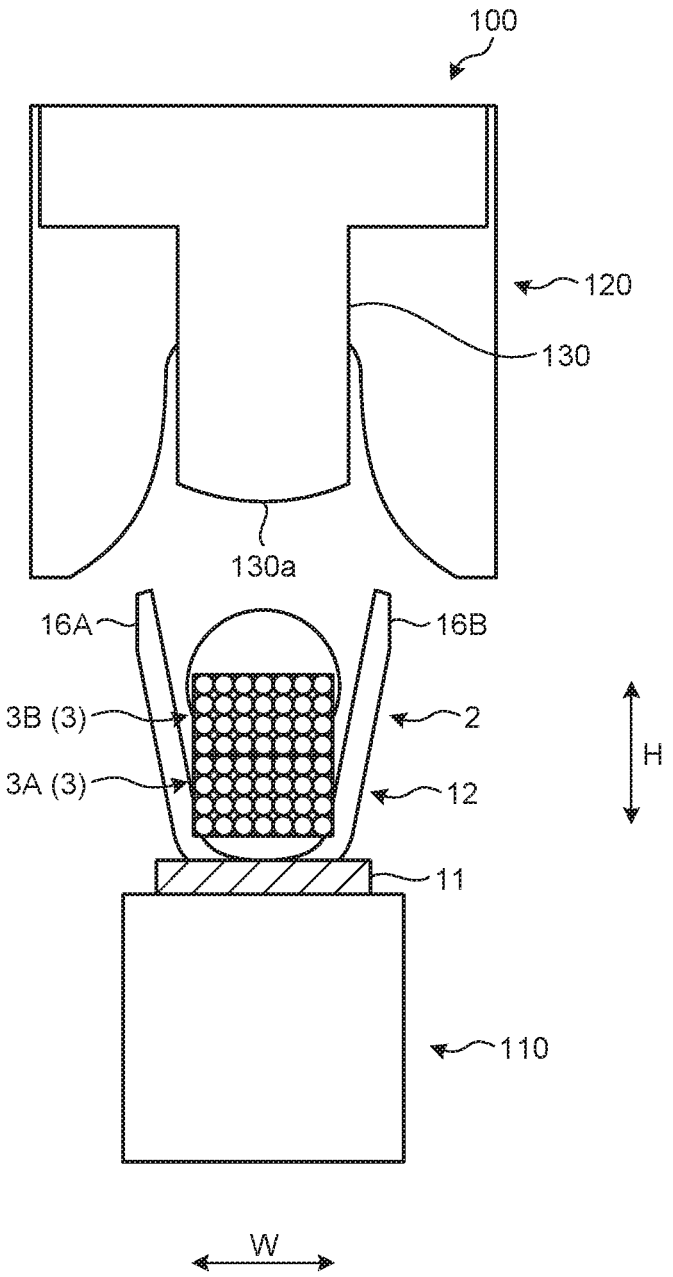
FIG. 38 is a sectional view for explaining a cutting process according to a fifth modification of the embodiment.
Figure 39:
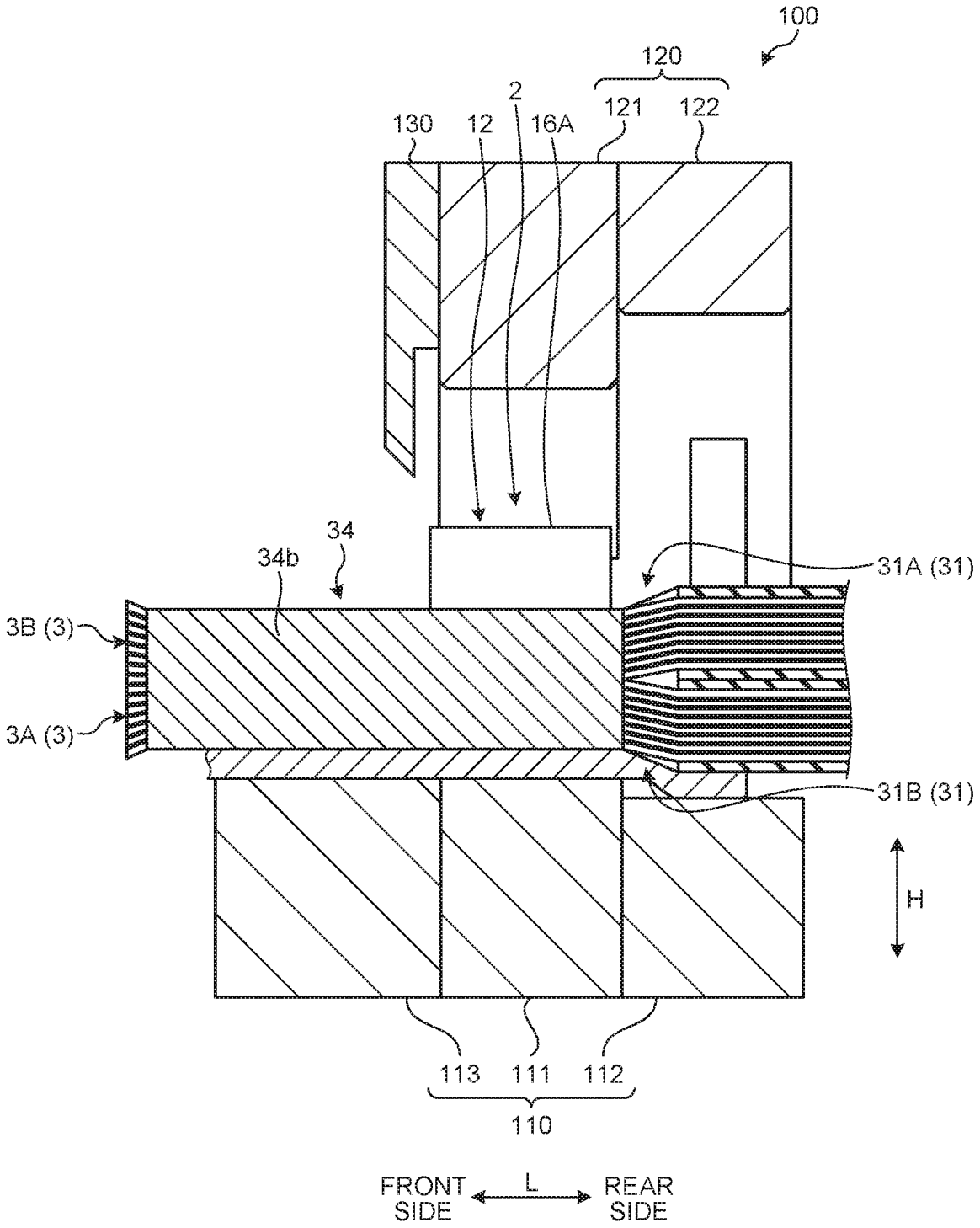
FIG. 39 is another sectional view for explaining the cutting process according to the fifth modification of the embodiment.

A fifth modification of the embodiment will now be described. FIG. 38 is a sectional view for explaining a cutting process according to the fifth modification of the embodiment. FIG. 39 is another sectional view for explaining the cutting process according to the fifth modification of the embodiment. For example, the fifth modification of the embodiment differs from the embodiment described above in forming the bonded part 34 by bonding a plurality of the core wires 31 of a plurality of the electric wires 3.

As illustrated in FIG. 38 and FIG. 39, in the crimping process according to the fifth modification of the embodiment, the crimp terminal 2 is crimped to two electric wires 3A and 3B. As illustrated in FIG. 39, core wires 31A and 31B of the two electric wires 3A and 3B are bonded together, thereby forming the single bonded part 34. In other words, the joining process is performed by bonding the core wire 31A of the electric wire 3A and the core wire 31B of the electric wire 3B together. Consequently, in the bonded part 34, the core wire 31A of the electric wire 3A and the core wire 31B of the electric wire 3B are bonded. The bonded part 34 is installed onto the crimp terminal 2 so that the two electric wires 3A and 3B are overlapped with each other in the third direction H. The electric wire 3A is mounted on the bottom part 15, and the electric wire 3B is overlapped on the electric wire 3A.

In the cutting process according to the fifth modification of the embodiment, the two electric wires 3A and 3B are cut together. The cutting unit 130 cuts the bonded part 34 while the caulking pieces 16A and 16B press the bonded part 34 toward the bottom part 15. The cutting unit 130 cuts the electric wire 3B at the upper side and then cuts the electric wire 3A at the lower side, while moving downward to the first mold 110.

With the fifth modification of the embodiment, it is possible to suppress the peeling off of the strands 32 and the cracking of the bonded part 34, in the electric wire with a terminal in which the single crimp terminal 2 is crimped to a plurality of the electric wires 3A and 3B.

Sixth Modification of Embodiment

Figure 40:
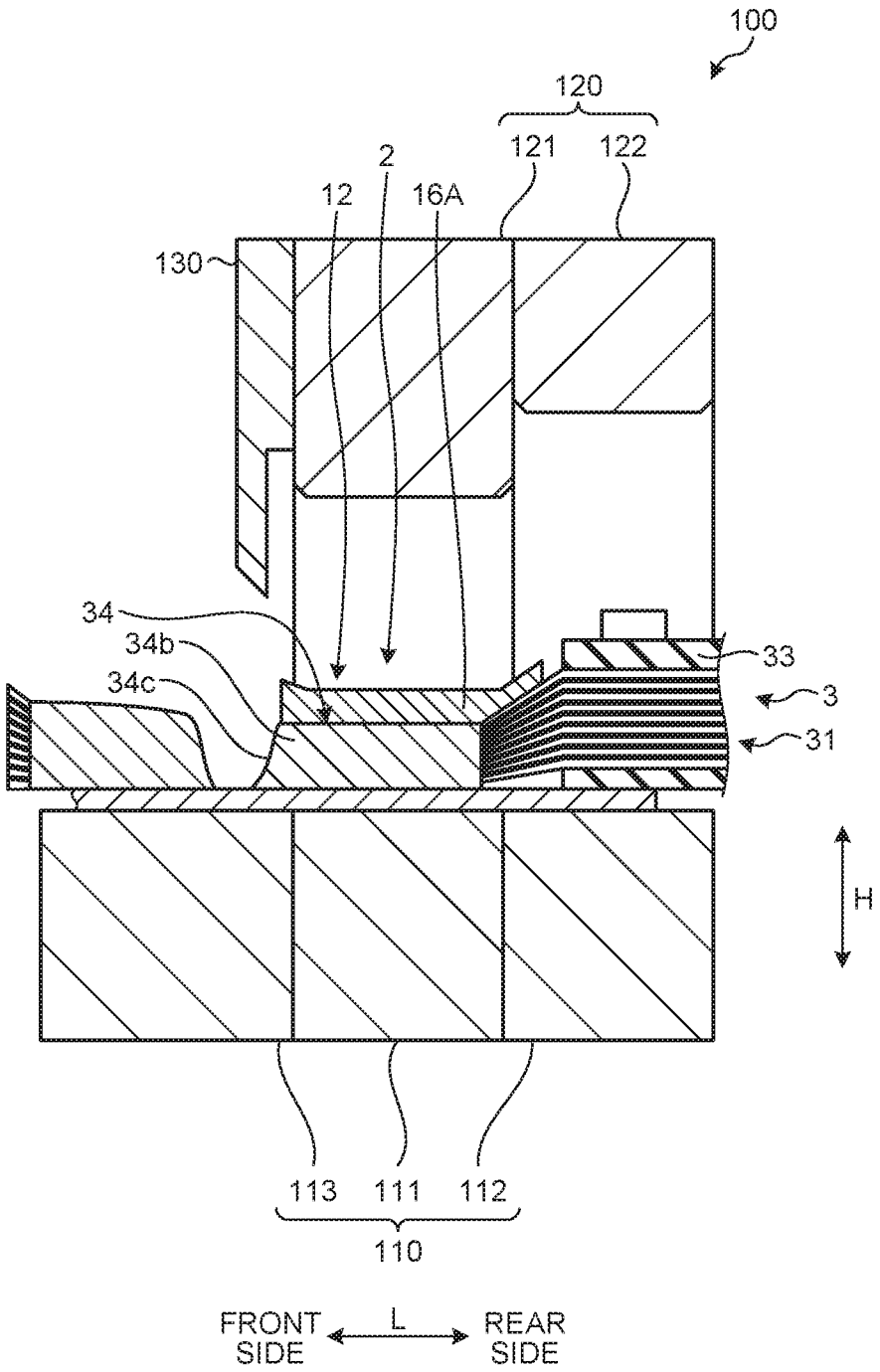
FIG. 40 is a sectional view for explaining a cutting process according to a sixth modification of the embodiment.

A sixth modification of the embodiment will now be described. FIG. 40 is a sectional view for explaining a cutting process according to the sixth modification of the embodiment. For example, the sixth modification of the embodiment differs from the embodiment described above in that the cutting unit 130 diagonally cuts the bonded part 34. The cutting unit 130 of the sixth modification cuts the bonded part 34 so that the tip end surface 34*c* of the bonded part 34 is formed in an inclined surface. The cutting shape of the bonded part 34 is not limited to the shape in the example, as long as the bonded part 34 is shaped so that interference does not occur with the other component.

In the embodiment described above, the bonded part 34 is cut by the terminal crimping device 100. However, instead of using the terminal crimping device 100, the bonded part 34 may also be cut by another device. In this case, the bonded part 34 is cut after the crimp terminal 2 is crimped to the electric wire 3. In other words, the cutting process is executed by another cutting device, after the crimping process is performed by the terminal crimping device 100.

The method of bonding the strands 32 of the core wire 31 is not limited to the ultrasonic bonding. In the bonding process, the bonded part 34 may also be formed by welding such as resistance welding and laser welding. Alternatively, the bonded part 34 may also be formed by soldering.

Figure 41:
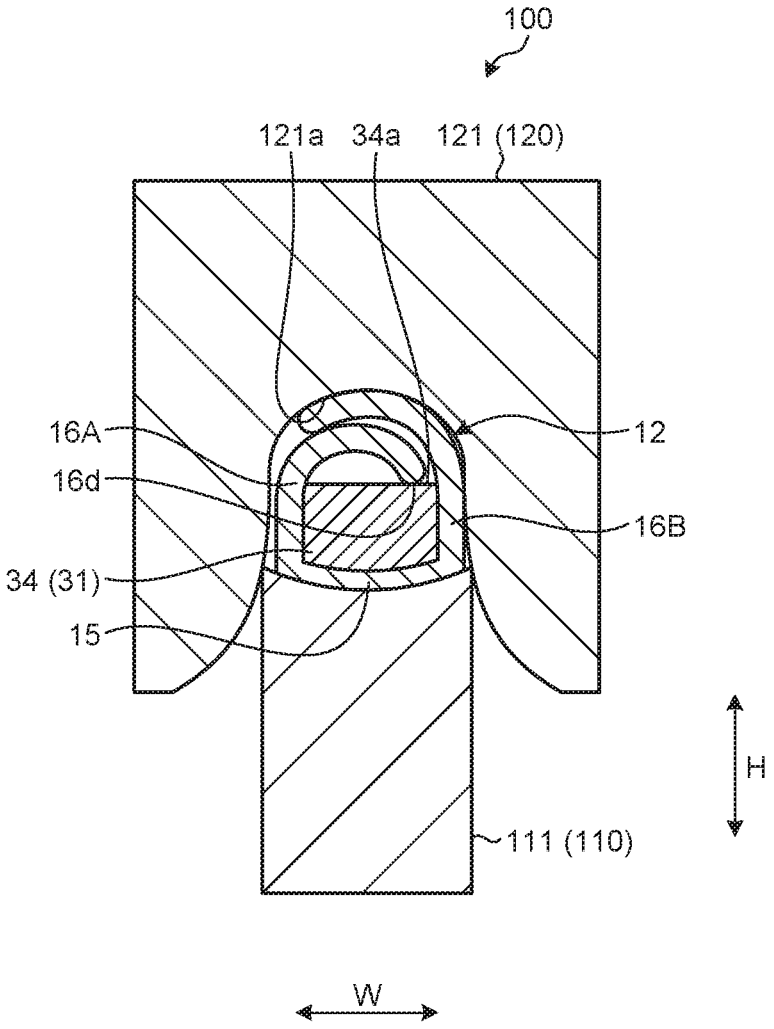
FIG. 41 is a sectional view for explaining the cutting process according to the sixth modification of the embodiment.

The caulking method of the caulking pieces 16A and 16B to the bonded part 34 is not limited to the mode of what is called the B crimp. For example, the caulking pieces 16A and 16B may also be wound around the bonded part 34 so that the second caulking piece 16B is overlapped on the first caulking piece 16A. In this case, as illustrated in FIG. 41, the first caulking piece 16A is placed inside the second caulking piece 16B. The cutting process is executed while the first caulking piece 16A is pressing the bonded part 34 toward the bottom part 15. For example, it is assumed that the tip end 16*d* of the first caulking piece 16A first comes into contact with the upper surface 34*a* of the bonded part 34. In this case, it is preferable that the cutting process is started at the same time when the tip end 16*d* starts pressing the bonded part 34 toward the bottom part 15, or after the tip end 16*d* starts pressing the bonded part 34 toward the bottom part 15. When the caulking pieces 16A and 16B are crimped in the overlapping method in this manner, the caulking pieces 16A and 16B may also be configured so as to integrally cover both of the bonded part 34 and the covering 33.

The caulking method of the covering crimping part 14 to the covering 33 is not limited to the mode of what is called the B crimp. For example, the caulking pieces 17A and 17B may be crimped by the overlapping method. The crimp terminal 2 may not include the covering crimping part 14.

The contents disclosed in the embodiment and the modifications described above may be implemented by a suitable combination.

The method for manufacturing the electric wire with a terminal according to the embodiment and the modifications includes a bonding process that forms a bonded part in which outer peripheral surfaces of a plurality of strands are bonded to one another on an end portion of a core wire having the strands, in an electric wire in which the end portion is exposed from a covering; an installation process that installs the bonded part onto a crimp terminal including a bottom part and a pair of caulking pieces extending from the bottom part and facing each other; a crimping process that crimps the caulking pieces to the bonded part, by sandwiching the crimp terminal and the electric wire between a first mold that supports the crimp terminal and a second mold that moves relative to the first mold; and a cutting process that cuts a tip end portion projecting to the outside from the caulking pieces in the bonded part by a cutting unit, while the caulking pieces are pressing the bonded part toward the bottom part.

With the method for manufacturing the electric wire with a terminal according to the embodiment and the modifications, the cutting process is performed while the caulking pieces are pressing the bonded part toward the bottom part. Consequently, it is possible to prevent the occurrence of cracking and the like in the bonded part. Thus, the method for manufacturing the electric wire with a terminal according to the embodiment and the modifications is capable of improving the electrical performance of an electric wire with a terminal.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An electric wire with a terminal, comprising:

an electric wire including a core wire, having a plurality of strands, and a covering that covers the core wire while an end portion of the core wire is exposed; and a crimp terminal including a core wire crimping part crimped to the core wire, wherein the crimp terminal includes a linking part that is a wall portion adjacent to a bottom part of the core wire crimping part in an axial direction of the electric wire, in the core wire, a portion at a tip end side thereof including a portion crimped to the core wire crimping part, is a bonded part in which outer peripheral surfaces of the plurality of strands are bonded to one another, a tip end surface of the bonded part projects to an outside from the core wire crimping part and is a cut surface, in the cut surface, end surfaces of the plurality of strands are brought into contact with one another, and face a same direction, and each of the end surfaces of the plurality of strands is sheared and deformed toward the linking part along a height direction of the crimp terminal.

2. The electric wire with a terminal according to claim 1, wherein the end surfaces of the plurality of strands that form the cut surface are sheared and deformed in a same direction.

* * * * *